US010106759B2

(12) United States Patent
DeSantis et al.

(10) Patent No.: US 10,106,759 B2
(45) **Date of Patent: *Oct. 23, 2018**

(54) SEAL COMPATIBILITY ADDITIVE TO IMPROVE FLUOROPOLYMER SEAL COMPATIBILITY OF LUBRICANT COMPOSITIONS

(71) Applicant: BASF SE, Ludwigshafen (DE)

(72) Inventors: Kevin DeSantis, Upper Nyack, NY (US); Michael Hoey, Maplewood, NJ (US); Al Jung, Carmel, NY (US); Phil Rabbat, Maplewood, NJ (US); David Chasan, Teaneck, NJ (US); Stephen Jones, Pomona, NY (US)

(73) Assignee: BASF SE, Ludwigshafen (DE)

( * ) Notice: Subject to any disclaimer, the term of this patent is extended or adjusted under 35 U.S.C. 154(b) by 154 days.

This patent is subject to a terminal disclaimer.

(21) Appl. No.: 14/258,871

(22) Filed: Apr. 22, 2014

(65) Prior Publication Data

US 2014/0315768 A1 Oct. 23, 2014

Related U.S. Application Data

(60) Provisional application No. 61/814,698, filed on Apr. 22, 2013.

(51) Int. Cl.

| | |
|---|---|
| ***C10L 1/22*** | (2006.01) |
| ***C10M 141/10*** | (2006.01) |
| ***C10M 141/06*** | (2006.01) |
| ***C10M 141/04*** | (2006.01) |
| ***C10M 169/04*** | (2006.01) |

(52) U.S. Cl.

CPC ..... *C10M 141/06* (2013.01); *C10M 141/04* (2013.01); *C10M 169/04* (2013.01); *C10M 2207/023* (2013.01); *C10M 2207/026* (2013.01); *C10M 2211/022* (2013.01); *C10M 2215/04* (2013.01); *C10M 2215/064* (2013.01); *C10M 2215/08* (2013.01); *C10M 2215/22* (2013.01); *C10M 2215/222* (2013.01); *C10M 2215/224* (2013.01); *C10M 2215/26* (2013.01); *C10M 2215/28* (2013.01); *C10M 2223/04* (2013.01); *C10M 2223/041* (2013.01); *C10M 2223/043* (2013.01); *C10M 2223/045* (2013.01); *C10M 2223/047* (2013.01); *C10M 2223/049* (2013.01); *C10N 2220/30* (2013.01); *C10N 2220/302* (2013.01); *C10N 2230/04* (2013.01); *C10N 2230/06* (2013.01); *C10N 2230/10* (2013.01); *C10N 2230/12* (2013.01); *C10N 2230/36* (2013.01); *C10N 2240/08* (2013.01); *C10N 2240/10* (2013.01); *C10N 2240/12* (2013.01); *C10N 2240/14* (2013.01); *C10N 2270/02* (2013.01)

(58) Field of Classification Search

CPC ..... C10M 131/06; C10M 131/04; C10M 133/40; C10M 131/02; C10M 2211/00; C10M 2211/086; C10M 2211/06

USPC ..... 508/260, 262

See application file for complete search history.

(56) References Cited

U.S. PATENT DOCUMENTS

| | | | | |
|---|---|---|---|---|
| 2,490,606 | A | 12/1949 | Williams et al. | |
| 3,138,629 | A | 6/1964 | Laughlin et al. | |
| 3,865,743 | A * | 2/1975 | Sheratte | C10M 3/00 252/78.5 |
| 4,153,418 | A | 5/1979 | Haas | |
| 4,289,501 | A | 9/1981 | Medcalf | |
| 4,430,092 | A | 2/1984 | Rosenthal | |
| 4,451,266 | A | 5/1984 | Barclay et al. | |
| 4,551,154 | A | 11/1985 | Malcosky et al. | |
| 4,941,986 | A | 7/1990 | Jolly | |
| 5,174,916 | A | 12/1992 | Osgood | |
| 5,503,760 | A | 4/1996 | Bongardt et al. | |
| 5,759,857 | A | 6/1998 | Goyal et al. | |
| 5,980,593 | A | 11/1999 | Friswell et al. | |
| 6,214,624 | B1 | 4/2001 | Barker et al. | |
| 6,262,126 | B1 | 7/2001 | Meinert | |
| 6,312,958 | B1 | 11/2001 | Meyer et al. | |
| 6,410,492 | B1 | 6/2002 | Shimomura et al. | |
| 7,932,218 | B2 | 4/2011 | Chasan et al. | |
| 8,158,432 | B2 | 4/2012 | Grof et al. | |
| 8,247,361 | B2 | 8/2012 | Shimura et al. | |
| 2002/0147116 | A1 | 10/2002 | Carrick et al. | |
| 2004/0029747 | A1 | 2/2004 | Emert et al. | |

(Continued)

FOREIGN PATENT DOCUMENTS

| | | |
|---|---|---|
| EP | 0456925 | 5/1990 |
| EP | 0 449 406 A1 | 10/1991 |

(Continued)

OTHER PUBLICATIONS

International Search Report for Application No. PCT/US2014/034983 dated Sep. 1, 2014, 4 pages.

(Continued)

*Primary Examiner* — Prem C Singh
*Assistant Examiner* — Francis C Campanell
(74) *Attorney, Agent, or Firm* — Lowenstein Sandler LLP

(57) ABSTRACT

This disclosure is directed to an additive package for a lubricant composition that provides improved compatibility with fluoropolymer seals. The additive package comprises a seal compatibility additive. The disclosure is also directed to a lubricant composition comprising a base oil and a seal compatibility additive. The seal compatibility additive improves the compatibility with fluoropolymer seals of the resultant lubricant composition.

17 Claims, No Drawings

(56) References Cited

U.S. PATENT DOCUMENTS

| | | | | |
|---|---|---|---|---|
| 2004/0248307 | A1* | 12/2004 | Grof | G01N 33/2882 436/56 |
| 2007/0157510 | A1* | 7/2007 | Grof | C10L 10/00 44/456 |
| 2007/0203031 | A1 | 8/2007 | Bardasz et al. | |
| 2008/0051306 | A1* | 2/2008 | Chasan | C10M 133/40 508/267 |
| 2008/0111100 | A1 | 5/2008 | Thomas et al. | |
| 2011/0041797 | A1 | 2/2011 | Strickland et al. | |
| 2011/0152145 | A1 | 6/2011 | Kamano et al. | |
| 2012/0149618 | A1 | 6/2012 | Yamaguchi et al. | |
| 2013/0005624 | A1 | 1/2013 | Kamano et al. | |
| 2014/0051621 | A1 | 2/2014 | DeSantis et al. | |
| 2014/0315767 | A1 | 10/2014 | DeSantis et al. | |
| 2015/0191673 | A1 | 7/2015 | DeSantis et al. | |

FOREIGN PATENT DOCUMENTS

| | | | |
|---|---|---|---|
| EP | 0 538 478 | A1 | 4/1993 |
| EP | 0 612 839 | A1 | 8/1994 |
| EP | 0 714 973 | A1 | 6/1996 |
| EP | 0 733 696 | A1 | 9/1996 |
| EP | 0 913 457 | A2 | 5/1999 |
| EP | 0 931 828 | A2 | 7/1999 |
| EP | 2 138 559 | A1 | 12/2009 |
| EP | 2 236 589 | A1 | 10/2010 |
| GB | 718567 | | 11/1954 |
| GB | 854964 | | 11/1960 |
| GB | 1 209 982 | | 10/1970 |
| JP | S4917803 | | 2/1974 |
| WO | WO 00/26327 | A1 | 5/2000 |
| WO | WO 02098199 | A2 | 12/2002 |
| WO | WO2008015116 | | 2/2008 |
| WO | WO2012082285 | | 6/2012 |
| WO | WO 2014028609 | A1 | 2/2014 |
| WO | WO 2014028629 | A1 | 2/2014 |

OTHER PUBLICATIONS

International Search Report for Application No. PCT/US2014/035016 dated Sep. 1, 2014, 4 pages.

International Search Report for Application No. PCT/US2014/035001 dated Sep. 4, 2014, 3 pages.

* cited by examiner

SEAL COMPATIBILITY ADDITIVE TO IMPROVE FLUOROPOLYMER SEAL COMPATIBILITY OF LUBRICANT COMPOSITIONS

CROSS-REFERENCE TO RELATED APPLICATIONS

This application claims priority to U.S. Provisional Patent Application No. 61/814,698, filed on Apr. 22, 2013, which is hereby incorporated by reference.

FIELD OF THE INVENTION

The present invention generally relates to a seal compatibility additive for a lubricant composition. More specifically, the invention relates to an additive package that includes a seal compatibility additive, to a lubricant composition including a seal compatibility additive, and to a method of lubricating a system including a fluoropolymer seal with the lubricant composition.

BACKGROUND OF THE INVENTION

It is known and customary to add stabilizers to lubricant compositions based on mineral or synthetic oils in order to improve their performance characteristics. Some amine compounds are effective stabilizers for lubricants. For example, certain amine compounds may help to disperse soot and maintain the cleanliness of engine components and other amine compounds may help neutralize acids formed during the combustion process. However, these amine compounds may cause detrimental effects on fluoropolymer seals.

It is an object of the present invention to provide new additives that improve the fluoropolymer seal compatibility of lubricant compositions.

SUMMARY OF THE INVENTION

The present invention provides an additive package for a lubricant composition that improves compatibility of the lubricant composition with fluoropolymer seals. The additive package includes a seal compatibility additive.

The present invention also provides a lubricant composition having improved compatibility with fluoropolymer seals. The lubricant composition includes a base oil and a seal compatibility additive.

The present invention also provides a method of lubricating a system including a fluoropolymer seal. The method includes providing a lubricant composition including a base oil and a seal compatibility additive.

Lubricant compositions including the seal compatibility additive demonstrate improved compatibility with fluoropolymer seals as demonstrated by CEC L-39-T96.

DETAILED DESCRIPTION OF THE DISCLOSURE

An additive package for a lubricant composition includes the seal compatibility additive. Alternatively, the additive package for a lubricant composition includes the seal compatibility additive and an amine compound. The additive package may be added to a base oil or a conventional lubricant composition. Both the additive package and the resultant lubricant composition (upon addition of the additive package) are contemplated and described collectively in this disclosure.

The seal compatibility additive, such as the seal compatibility additive including at least one iodine atom, creates a beneficial seal compatibility effect in the lubricant composition. In certain embodiments, the seal compatibility additive in combination with an amine compound exhibits a beneficial seal compatibility effect.

The seal compatibility additive includes at least one halogen atom. Beyond that, the seal compatibility additive may take many forms. For example, the seal compatibility additive may include a hydrocarbon backbone. Furthermore, the seal compatibility additive may include an alkyl halide compound, or may be a quaternary amine compound having at least one halogen atom bonded thereto. Alternatively still, the seal compatibility additive may be an elemental halogen, such as $Br_2$ and $I_2$. In certain embodiments, the seal compatibility additive includes at least one iodine atom.

In one or more embodiments, the seal compatibility additive includes a hydrocarbon backbone and at least one halogen atom bonded to a carbon atom in the hydrocarbon backbone. In certain embodiments, the seal compatibility additive includes the hydrocarbon backbone and at least one iodine atom. The seal compatibility additive may be straight or branched. The hydrocarbon backbone may be cyclic or acyclic. The hydrocarbon backbone may include from 1 to 30, 2 to 25, 2 to 20, 2 to 15, 9 to 15, or 9 to 12, carbon atoms. As used herein, the term "acyclic" is intended to refer to hydrocarbon backbones which are free from any cyclic structures and to exclude aromatic structures.

In some aspects, the seal compatibility additive may include at least one pendant group. In some embodiments, the at least one pendant group is selected from alcohol groups, alkoxy groups, alkenyl groups, alkynyl groups, amine groups, aryl groups, alkylary groups, arylalkyl groups, heteroaryl groups, alkyl groups, cycloalkyl groups, cycloalkenyl, amide groups, ether groups, ester groups, and combinations thereof, each having from 1 to 30, 1 to 20, 1 to 15, or 3 to 12, carbon atoms. Each of these pendant groups may be bonded to a carbon atom positioned in the hydrocarbon backbone of the seal compatibility additive.

In one embodiment, the seal compatibility additive is cyclic, meaning that the seal compatibility additive includes the hydrocarbon backbone and that the hydrocarbon backbone includes at least one pendant cyclic group, that the hydrocarbon backbone is cyclic, or both. In another embodiment, the seal compatibility additive is acyclic, meaning that the hydrocarbon backbone is acyclic and that the seal compatibility additive is free from pendant cyclic groups. Alternatively, the hydrocarbon backbone of the seal compatibility additive may be free of pendant and/or functional groups bonded to the carbon atoms in the hydrocarbon backbone other than the halogen atom.

The hydrocarbon backbone of the seal compatibility additive may include functional groups, such as hydroxyl, carboxyl, carbonyl, epoxy, oxide, thio, and thiol groups. One or more of these functional groups may be bonded to hydrocarbon backbone of the seal compatibility additive. The hydrocarbon backbone of the seal compatibility additive may also include at least one heteroatom, such as oxygen, sulfur, and nitrogen heteroatoms; or at least one heterogroup, such as pyridyl, furyl, thienyl, and imidazolyl. In addition, or as an alternative, the hydrocarbon backbone may be free from heteroatoms and heterogroups. For example, the hydrocarbon backbone may be free from oxygen hetero atoms. The hydrocarbon backbone may be saturated or unsaturated.

As described above, the seal compatibility additive may include fluorine atoms, chlorine atoms, bromine atoms, iodine atoms, and combinations thereof. Alternatively, the seal compatibility additive may include fluorine atoms, bromine atoms, iodine atoms, and combinations thereof. In certain embodiments, the seal compatibility additive is free from chlorine atoms. Each of these halogen atoms may be bonded to a carbon atom in the hydrocarbon backbone of the seal compatibility additive or a carbon atom in one of the pendant groups of the hydrocarbon backbone of the seal compatibility additive. The seal compatibility additive may include 1, 2, 3, 4, 5, 6, 7, 8, 9, 10, or more halogen atoms per molecule. It is also contemplated that two or more different, or that two or more of the same, halogen atoms may be present in the same seal compatibility additive. For example, the seal compatibility additive may include at least one iodine atom and at least one bromine atom.

As described above, the seal compatibility additive may include the alkyl halide compound. The alkyl halide compound may have a general formula:

$$C_nH_{2n+2-m}X_m \quad \text{(I).}$$

In formula (I), $n \geq 1$, $1 \leq m \leq (2n+2)$, and X is a halogen atom. X may be selected from the group including fluorine, bromine, iodine, and combinations thereof. In some embodiments, n may range from 1 to 30, 2 to 25, 2 to 20, 2 to 15, 9 to 15, or 9 to 12; and m may have a value of 1, 2, 3, 4, 5, 6, or more. The alkyl halide compound may be primary, secondary, or tertiary. The alkyl halide compound may be a mono-halide, di-halide, tri-halide, or tetrahalide in some embodiments. It is also contemplated that two or more different, or two or more of the same, halogen atoms may be present in the same alkyl halide compound. For example, the seal compatibility additive may include 1,4 diiodobutane or 1-iodo-4-bromobutane.

The quaternary halogen compound may be understood as a quaternary amine salt that includes at least one halogen atom bonded thereto. The halogen atoms may be bonded along the body of the quaternary amine salt or may be bonded to the quaternary amine salt as a halide counter-ion. The quaternary amine compound may include 1, 2, 3, 4, 5, or more nitrogen atoms. The quaternary amine compound may also include 1, 2, 3, 4, 5, or more halogen atoms. It is also contemplated that two or more different halogen atoms may be present in the same quaternary amine compound. The quaternary amine compound may include a variety of different pendent groups, such as alkyl, aryl, alkenyl, alkynyl, cycloalkyl, arylalkyl, or heteroaryl groups, each having from 1 to 30, 1 to 20, 1 to 15, or 3 to 12, carbon atoms, and may be further substituted by at least one amine, imine, hydroxyl, halogen, and/or carboxyl group. The quaternary amine compound may be cyclic or acyclic.

Exemplary seal compatibility additives include:

Tetrabromoethane:

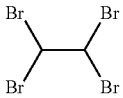

Tetrafluoroethane:

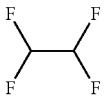

-continued 1,2-dibromoethane:

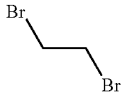

Dibromoethane:

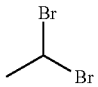

Trifluoro-1,2,2-dibromoethane:

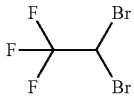

1-fluorooctane:

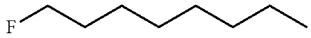

1-iodododecane:

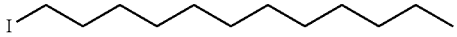

1-bromododecane:

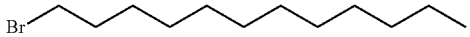

Ethyliodide:

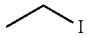

Ethylbromide:

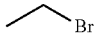

Tribromopropane:

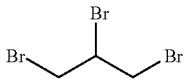

Dibromo-cyclohexane:

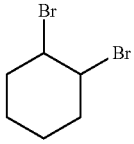

1-bromo, 4-fluoro cyclohexane:

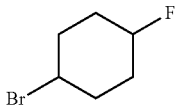

1-iodopropane:

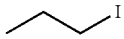

1-bromopropane:

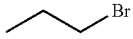

Octylbromide:

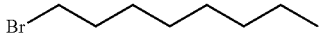

1-iodohexane:

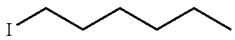

1-bromohexane:

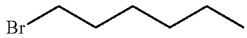

Butylbromide:

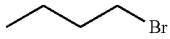

3-iodo-1-propanol:

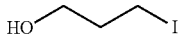

-continued 1,4-dibromobutane:

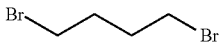

1,4-diiodobutane:

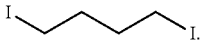

The seal compatibility additive, such as the seal compatibility additive including at least one iodine atom, may have a weight average molecular weight ranging from 50 to 1500, 50 to 1000, 100 to 500, 150 to 500, 200 to 500, or 250 to 500.

The seal compatibility additive, such as the seal compatibility additive including one or more iodine atoms, may have a boiling point ranging from 50 to 650, 100 to 450, 135 to 450, 140 to 450, 145 to 450, 150 to 450, 155 to 450, or 200 to 400, ° C., at 1 atmosphere. Alternatively, the seal compatibility additive may have a boiling point of at least 100, at least 110, at least 120, at least 130, at least 140, at least 150, or at least 160, ° C., at 1 atmosphere, and less than 450, less than 400, less than 350, less than less than 300, or less than 250, ° C., at 1 atmosphere.

The seal compatibility additive may also be characterized as having a flash point ranging from 10 to 300, 25 to 250, 50 to 250, 75 to 250, or 85 to 200, ° C. Alternatively, the seal compatibility additive may have a flash point of at least 10, at least 15, at least 20, at least 25, at least 30, at least 35, at least 40, at least 45, at least 50, at least 55, at least 60, at least 65, at least 70, at least 75, at least 80, or at least 85, ° C., and a flash point less than 250, less than 225, less than 200, less than 175, less than 150, or less than 125, ° C.

In certain embodiments, the seal compatibility additive is a liquid at a temperature of 25, 30, 35, 40, 45, 50, 55, 60, 65, 70, 75, 80, 85, 90, 95 or 100, ° C., and 1 atmosphere The seal compatibility additive may be synthesized in a variety of ways. For example, the seal compatibility additive can be prepared by reacting an alkene with a hydrogen halide, such as hydrogen chloride or hydrogen bromide to yield the corresponding monohalogenated alkane. Alternatively, the seal compatibility additive may be prepared by reacting an alcohol with a hydrogen halide. Alternatively still, the seal compatibility additive may be prepared by reacting an alkyl alcohol with carbon tetrabromide, sodium bromide, and a ruthenium catalyst, all in a dimethylformamide solvent. The carbon tetrabromide may be replaced with other compounds if compounds including halogen atoms other than bromide are desired.

In certain embodiments, at least 50, at least 60, at least 70, at least 80 or, at least 90, wt. %, of the seal compatibility additive remains unreacted in the additive package and/or lubricant composition based on the total weight of seal compatibility additive utilized to form the additive package and/or the lubricant composition prior to any reaction in the additive package or the lubricant composition. Alternatively, at least 95, at least 96, at least 97, at least 98, or at least 99, wt. %, of the seal compatibility additive remains unreacted in the additive package and/or the lubricant composition based on the total weight of the seal compatibility additive prior to any reaction in the additive package or the lubricant composition.

The term "unreacted" refers to the fact that the unreacted amount of the seal compatibility additive does not react with any components in the additive package or lubricant composition. Accordingly, the unreacted portion of the seal compatibility additive remains in its virgin state when present in the additive package or the lubricant composition before the lubricant composition has been used in an end-use application, such as an internal combustion engine.

The phrase "prior to any reaction" refers to the basis of the amount of the seal compatibility additive in the additive package or lubricant composition. This phrase does not require that the seal compatibility additive reacts with other components in the additive package or the lubricant composition, i.e., 100 wt. % of the seal compatibility additive may remain unreacted in the additive package and/or the lubricant composition based on the total weight of the seal compatibility additive prior to any reaction in the additive package and/or the lubricant composition.

In one embodiment, the percentage of the seal compatibility additive that remains unreacted is determined after all of the components which are present in the additive package or lubricant composition reach equilibrium with one another. The time period necessary to reach equilibrium in the additive package or lubricant composition may vary widely. For example, the amount of time necessary to reach equilibrium may range from a single minute to many days, or even weeks. In certain embodiments, the percentage of the seal compatibility additive that remains unreacted in the additive package or lubricant composition is determined after 1 minute, 1 hour, 5 hours, 12 hours, 1 day, 2 days, 3 days, 1 week, 1 month, 6 months, or 1 year.

In certain embodiments, the seal compatibility additive reacts with the amine compound to form a reaction product or other reaction intermediate, such as a salt. Depending on the composition of the seal compatibility additive, the salt may be an ammonium halide. Alternatively, the seal compatibility additive may interact with the amine compound to form a reaction complex. As such, in some embodiments, the lubricant composition or the additive package may include the reaction product, reaction intermediate, or reaction complex formed by the reaction or interaction of the seal compatibility additive and the amine compound.

It is also believed that the seal compatibility additive, such as the seal compatibility additive including at least one iodine atom, creates a beneficial antioxidant effect in the lubricant composition. A VIT (viscosity increase test) may be utilized to quantify this beneficial antioxidant benefit. The antioxidant benefit is quantified by an increase in hours measured when the KV 40 is 150% compared to that of the initial KV 40. The KV40 is determined by the method of ASTM D445. In certain embodiments, the addition of the seal compatibility additive increases the number of hours to reach the 150% viscosity of KV 40 by at least 10, 25, 50, 75, 100, 150, 200, 250, 300, 350, or 400, %, relative the number of hours exhibited by the same lubricant composition without the seal compatibility additive.

The TAN, TBN cross-over point is also measured as an indicator of the beneficial antioxidant effect. As oil is aged the TAN increases while the TBN decreases. The point at which they cross each other is called the TAN, TBN cross-over point. In certain embodiments, the addition of the seal compatibility additive increases the number of hours to reach the TAN, TBN cross-over point by at least 10, 25, 50, 75, 100, 150, 200, 250, 300, 350, or 400, %, relative the number of hours exhibited by the same lubricant composition without the seal compatibility additive.

It is also believed that the seal compatibility additive creates a beneficial anti-deposition effect in the lubricant composition. The lubricant composition including the seal compatibility additive and the amine compound may also create a beneficial anti-deposition effect in the lubricant composition. A TEOST (Thermo-oxidation Engine Oil Simulation Test) may be used to quantify this beneficial anti-deposition effect. In one embodiment, the TEOST MHT® test (ASTM D 7097) may be used to evaluate this benefit. In this MHT test, 8.5 g of sample oil with catalyst is continuously passed over a pre-weighed steel Depositor Rod for 24 hours at 285° C. The increase in rod weight caused by deposits was used as a measure of oil performance. In certain embodiments, the addition of the seal compatibility additive and/or the amine compound decreases the weight of the deposits by at least 0.5, 1, 5, 10, 15, 20, 30, 40, or 50, mg, relative to the amount of deposits resulting from testing the same lubricant composition without the seal compatibility additive and/or the amine compound.

It is also believed that, in certain embodiments, the seal compatibility additive creates a beneficial anti-corrosion effect in the lubricant composition, especially with respect to copper. The lubricant composition including the seal compatibility additive and the amine compound may also create a beneficial anti-corrosion effect in the lubricant composition, especially with respect to copper. A High Temperature Corrosion Bench Test (HTCBT) according to ASTM D 6594 may be used to quantify this beneficial anti-corrosion effect.

In the context of the additive package, the seal compatibility additive, such as the seal compatibility additive including at least one iodine atom, can be present in an amount ranging from 0.1 to 100, 5 to 50, or 10 to 40, wt. %, based on the total weight of the additive package. In the context of a lubricant composition, the seal compatibility additive, such as the seal compatibility additive including at least one iodine atom, can be present in an amount ranging from 0.01 to 10, 0.05 to 5, 0.1 to 3, 0.1 to 2, or 0.5 to 1.5, wt. %, based on the total weight of the lubricant composition. The additive package or lubricant composition may include mixtures of different seal compatibility additives. By way of example, the additive package may consist of one or more seal compatibility additives.

The seal compatibility additive, such as the seal compatibility additive including at least one iodine atom, may be combined with an amine compound in the lubricant composition or additive package. It should be appreciated that mixtures of different amine compounds may also be combined with the seal compatibility additive in the lubricant composition and/or additive package The amine compound includes at least one nitrogen atom. Furthermore, in some configurations, the amine compound does not include triazoles, triazines, or similar compounds where there are three or more nitrogen atoms in the body of a cyclic ring. The amine compound may be aliphatic.

In certain embodiments, the amine compound has a total base number (TBN) value of at least 10 mg KOH/g when tested according to ASTM D4739. Alternatively, the amine compound has a TBN value of at least 15, at least 20, at least 25, at least 90, at least 100, at least 110, at least 120, at least 130, at least 140, at least 150, or at least 160, mg KOH/g, when tested according to ASTM D4739. Alternatively still, the amine compound may have a TBN value of from 80 to 200, 90 to 190, 100 to 180, or 100 to 150, mg KOH/g, when tested according to ASTM D4739.

In some embodiments, the amine compound does not negatively affect the TBN of the lubricant composition. Alternatively, the amine compound may improve the TBN of the lubricant composition by, at least 0.5, at least 1, at least 1.5, at least 2, at least 2.5, at least 3, at least 3.5, at least 4, at least 4.5, at least 5, at least 10, or at least 15, mg KOH/g of the amine compound. The TBN value of the lubricant composition can be determined according to ASTM D2896.

In some embodiments, the amine compound consists of, or consists essentially of, hydrogen, carbon, nitrogen, and oxygen. Alternatively, the amine compound may consist of, or consist essentially of, hydrogen, carbon, and nitrogen. In the context of the amine compound, the phrase "consist essentially of" refers to compounds where at least 95 mole % of the amine compound are the recited atoms (i.e., hydrogen, carbon, nitrogen, and oxygen; or hydrogen, carbon, and nitrogen). For example, if the amine compound consists essentially of hydrogen, carbon, nitrogen, and oxygen, at least 95 mole % of the amine compound is hydrogen, carbon, nitrogen, and oxygen. In certain configurations, at least 96, at least 97, at least 98, at least 99, or at least 99.9, mole %, of the amine compound are hydrogen, carbon, nitrogen and oxygen, or, in other embodiments, are carbon, nitrogen, and hydrogen.

The amine compound may consist of covalent bonds. The phrase "consist of covalent bonds" is intended to exclude those compounds which bond to the amine compound through an ionic association with at least one ionic atom or compound. That is, in configurations where the amine compound consists of covalent bonds, the amine compound excludes salts of amine compounds, for example, phosphate amine salts and ammonium salts. As such, in certain embodiments, the lubricant composition is free of a salt of the amine compound. More specifically, the lubricant composition may be free of a phosphate amine salt, ammonium salt, and/or amine sulfate salt.

The amine compound may include a monomeric acyclic amine compound having a weight average molecular weight of less than 500. Alternatively, the monomeric acyclic amine compound may have a weight average molecular weight of less than 450, less than 400, less than 350, less than 300, less than 250, less than 200, or less than 150. Alternatively still, the amine compound may have a weight average molecular weight of at least 30, at least 50, at least 75, at least 100, at least 150, at least 200, or at least 250.

The term "acyclic" is intended to refer to amine compounds which are free from any cyclic structures and to exclude aromatic structures. For example, the monomeric acyclic amine compound does not include compounds having a ring having at least three atoms bonded together in a cyclic structure and those compounds including benzyl, phenyl, or triazole groups.

The monomeric acyclic amine compound may be exemplified by general formula (II):

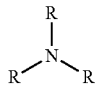

(II)

where each R is independently a hydrogen atom or a hydrocarbyl group. Each hydrocarbyl group designated by R may independently be substituted or unsubstituted, straight or branched, alkyl, alkenyl, cycloalkyl, cycloalkenyl, aryl, alkylaryl, arylalkyl group, or combinations thereof. Each hydrocarbyl group designated by R may independently include from 1 to 100, 1 to 50, 1 to 40, 1 to 30, 1 to 20, 1 to 15, 1 to 10, 1 to 6, or 1 to 4, carbon atoms. Alternatively, each hydrocarbyl group designated by R may independently include less than 20, less than 15, less than 12, or less than 10, carbon atoms.

By "unsubstituted," it is intended that the designated hydrocarbyl group or hydrocarbon group is free from substituent functional groups, such as alkoxy, amide, amine, keto, hydroxyl, carboxyl, oxide, thio, and/or thiol groups, and that the designated hydrocarbyl group or hydrocarbon group is free from heteroatoms and/or heterogroups.

Alternatively, each hydrocarbyl group designated by R may be independently substituted, and include at least one heteroatom, such as oxygen, nitrogen, sulfur, chlorine, fluorine, bromine, or iodine, and/or at least one heterogroup, such as pyridyl, furyl, thienyl, and imidazolyl. Alternatively, or in addition to including heteroatoms and heterogroups, each hydrocarbyl group designated by R may independently include at least one substituent group selected from alkoxy, amide, amine, carboxyl, epoxy, ester, ether, hydroxyl, keto, metal salt, sulfuryl, and thiol groups. Alternatively, each hydrocarbyl group designated by R may be independently unsubstituted.

Exemplary alkyl groups include methyl, ethyl, propyl, isopropyl, n-butyl, isobutyl, sec-butyl, tert-butyl, pentyl, iso-amyl, hexyl, 2-ethylhexyl, octyl and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

The monomeric acyclic amine compound includes monoamines and polyamines (including two or more amine groups). In certain embodiments, at least one group designated by R is unsubstituted. Alternatively, two or three groups designated by R are unsubstituted. Alternatively still, it is contemplated that one, two, or three groups designated by $R^{13}$ are substituted.

Exemplary monomeric acyclic amine compounds include, but are not limited to, primary, secondary, and tertiary amines, such as:

methylamine:

$H_2N—CH_3$ dimethylamine:

$H_3C—NH—CH_3$ trimethylamine:

$(H_3C)_3N$ ditridecylamine:

$H_3C—(CH_2)_{13}—NH—(CH_2)_{13}—CH_3$.

ethanolamine:

$H_2N—CH_2—CH_2—OH$ methylethanolamine:

$H_3C—NH—CH_2—CH_2—OH$ bis (2-ethyhexyl) amine:

$(H_3C—CH_2—CH_2—CH_2—CH(CH_3))_2NH$

The monomeric acyclic amine compound may alternatively include at least one primary amines such as ethylamine, n-propylamine, isopropylamine, n-butylamine, isobutylamine, sec-butylamine, tert-butylamine, pentylamine, and hexylamine; primary amines of the formulas: $CH_3—O—C_2H_4—NH_2$, $C_2H_5—O—C_2H_4—NH_2$, $CH_3—O—C_3H_6—NH_2$, $C_2H_5—O—C_3H_6—NH_2$, $C_4H_9—O—C_4H_8—NH_2$, $HO—C_2H_4—NH_2$, $HO—C_3H_6—NH_2$ and $HO—C_4H_8—NH_2$; secondary amines, for example diethylamine, methylethylamine, di-n-propylamine, diisopropylamine, diisobutylamine, di-sec-butylamine, di-tert-butylamine, dipentylamine, dihexylamine; and also secondary amines of the formulas: $(CH_3—O—C_2H_4)_2NH$, $(C_2H_5—O—C_2H_4)_2NH$, $(CH_3—O—C_3H_6)_2NH$, $(C_2H_5—O—C_3H_6)_2NH$, $(n\text{-}C_4H_9—O—C_4H_8)_2NH$, $(HO—C_2H_4)_2NH$, $(HO—C_3H_6)_2NH$ and $(HO—C_4H_8)_2NH$; and polyamines, such as n-propylenediamine, 1,4-butanediamine, 1,6-hexanediamine, diethylenetriamine, triethylenetetramine and tetraethylenepentamines, and also their alkylation products, for example 3-(dimethylamino)-n-propylamine, N,N-dimethylethylenediamine, N,N-diethylethylenediamine, and N,N,N',N'-tetramethyldiethylenetriamine.

Alternatively, the amine compound may be a monomeric cyclic amine compound. The monomeric cyclic amine compound may have a weight average molecular weight of from 100 to 1200, 200 to 800, or 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

The monomeric cyclic amine compound may be exemplified by the general formula (III):

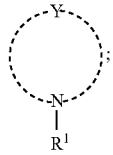

(III)

or general formula (IV):

(IV)

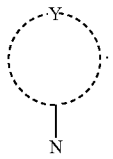

In general formulas (III) and (IV), Y represents the type and number of atoms necessary to complete the cyclic ring of general formulas (III) or (IV). The ring designated by Y may include from 2 to 20, 3 to 15, 5 to 15, or 5 to 10, carbon atoms. The ring designated by Y may be a substituted or unsubstituted, branched or unbranched, divalent hydrocarbon group that includes at least one hetero atom, such as oxygen, or sulfur, and may include at least one heterogroup. In addition to including heteroatoms and/or heterogroups, the ring designated by Y may include at least one hydrocarbyl substituent group, as described above with respect to R in general formula (II). In certain embodiments, the ring designated by Y is free from nitrogen heteroatoms, or free from any heteroatoms. The heteroatoms, heterogroups, and/or substituent groups may be bonded to different atoms in the divalent hydrocarbon group designated by Y. The substituent nitrogen atom in general formula (IV) may be bonded to at least one hydrogen atom, or may be bonded to one or two hydrocarbyl groups.

In formula (III), $R^1$ is a hydrogen atom or a hydrocarbyl group. The hydrocarbyl group designated by $R^1$ may have the same meaning as R described above with respect to formula (II). For example, $R^1$ may be an alcohol group, an amino group, an alkyl group, an amide group, an ether group, or an ester group. $R^1$ may have 1 to 50, 1 to 25, 1 to 17, 1 to 15, 1 to 12, 1 to 8, 1 to 6, or 1 to 4, carbon atoms. $R^1$ may be straight or branched. For example, each $R^1$ may be an alcohol group, amino group, alkyl group, amide group, ether group, or ester group having 1 to 50 carbon atoms, with the designated functional group (alcohol, etc.), heteroatom, or heterogroup bonded at various positions on the carbon atoms in the backbone. The substituent nitrogen atom in general formula (IV) may be bonded to at least one hydrogen atom, or may be bonded to one or two hydrocarbyl groups, such as those described above with respect to $R^1$.

In one embodiment, the monomeric cyclic amine compound may be exemplified by general formula (V):

(V)

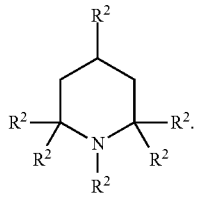

In general formula (V), each $R^2$ is independently a hydrogen atom or a hydrocarbyl group having from 1 to 17 carbon atoms. The hydrocarbyl group designated by $R^2$ may have the same meaning as R in general formula (II). For example, each $R^2$ may independently be substituted with an alcohol group, an amino group, an amide group, an ether group, or an ester group. Each $R^2$ may independently have from 1 to 17, 1 to 15, 1 to 12, 1 to 8, 1 to 6, or 1 to 4, carbon atoms. In certain embodiments, at least one group designated by $R^2$ is unsubstituted. Alternatively, at least two, three, four, five, or six groups designated by $R^2$ are unsubstituted. Alternatively still, it is contemplated that one, two, three, four, five, or six groups designated by $R^2$ are substituted. For example, each $R^2$ may be an alcohol group, amino group, alkyl group, amide group, ether group, or ester group having 1 to 17 carbon atoms, with the designated functional group (alcohol, etc) bonded at various positions on the carbon chain.

Exemplary monomeric cyclic amine compounds include:

cyclopentylamine:

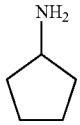

cyclohexylamine:

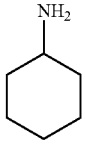

aziridine:

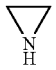

piperidine:

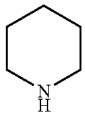

n-methylpiperidine:

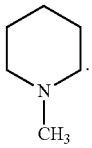

In some embodiments, the amine compound, such as the monomeric acyclic amine compound or the monomeric cyclic amine compound may be a sterically hindered amine compound. The sterically hindered amine compound may have a weight average molecular weight of from 100 to 1200. Alternatively, the sterically hindered amine compound may have a weight average molecular weight of from 200 to 800, or 200 to 600. Alternatively still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. In other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiary nitrogen atom.

The sterically hindered amine compound may have general formula (VI) or (VII):

(VI)

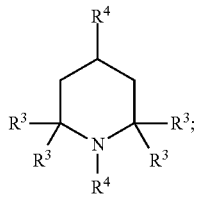

(VII)

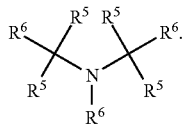

In general formula (VI), each $R^3$ is independently a hydrogen atom or a hydrocarbyl group having from 1 to 17 carbon atoms, wherein at least two of $R^3$ are an alkyl group in one molecule; and $R^4$ is independently a hydrogen atom or a hydrocarbyl group having from 1 to 17 carbon atoms. In general formula (VII), each $R^5$ is independently a hydrogen atom or a hydrocarbyl group having from 1 to 17 carbon atoms, wherein at least two of $R^5$ are an alkyl group, and each $R^5$ is independently a hydrogen atom or a hydrocarbyl group having from 1 to 17 carbon atoms.

The groups designated by $R^3$, $R^4$, $R^5$, and $R^6$ may have the same meaning as R described above with respect to general formula (II). For example, each $R^3$, $R^4$, $R^5$, and $R^6$ may independently substituted with an alcohol group, an amide group, an ether group, or an ester group, and each $R^3$, $R^4$, $R^5$, and $R^6$ may independently have from 1 to 17, 1 to 15, 1 to 12, 1 to 8, 1 to 6, or 1 to 4, carbon atoms.

In certain embodiments, at least one group designated by $R^3$, $R^4$, $R^5$, and $R^6$ is unsubstituted. Alternatively, at least two, three, four, five, or six groups designated by $R^3$, $R^4$, $R^5$, and $R^6$ are unsubstituted. In other embodiments, every group designated by $R^3$, $R^4$, $R^5$, and $R^6$ is unsubstituted. Alternatively still, it is contemplated that one, two, three, four, five, or six groups designated by $R^3$, $R^4$, $R^5$, and $R^6$ are substituted.

Exemplary $R^3$, $R^4$, $R^5$, and $R^6$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

In general formula (VI), at least two, at least three, or all four groups, designated by $R^5$ are each independently an alkyl group. Similarly, in general formula (VII), at least two groups designated by $R^5$ are an alkyl group. Alternatively, at least three, or all four groups, designated by $R^5$ are an alkyl group.

The sterically hindered amine compound of general formula (VI) may be exemplified by the following compounds:

2,2,6,6-tetramethyl-4-octylpiperdine:

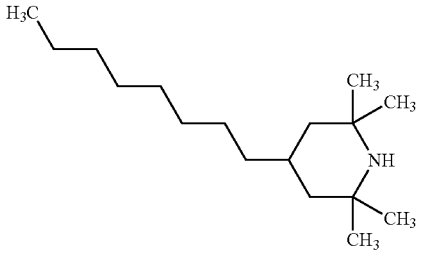

2,2,6,6-tetramethyl-4-decylpiperdine:

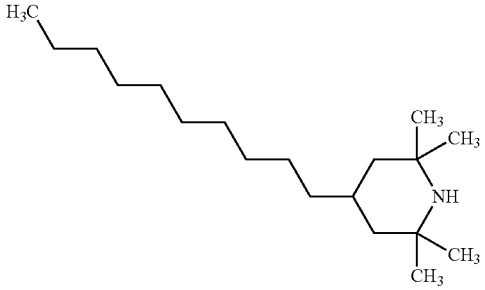

2,2,6,6-tetramethyl-4-butylpiperdine:

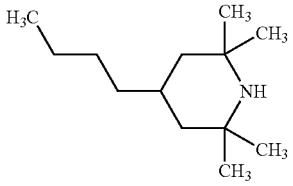

2,2,6,6-tetramethyl-4-hexadecylpiperdine:

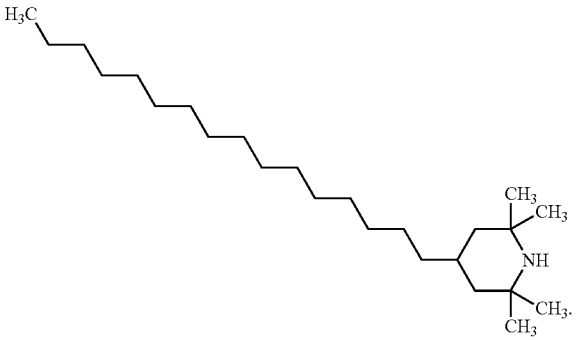

The sterically hindered amine compound of general formula (VII) is acyclic. The term "acyclic" is intended to mean that the sterically hindered amine compound of general formula (VII) is free from any cyclic structures and aromatic structures. The sterically hindered amine compound of general formula (VII) can be exemplified by:

N-tert-butyl-2-ethyl-N-methyl-hexan-1-amine:

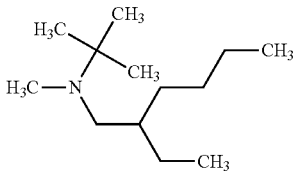

-continued tert-amyl-tert-butylamine:

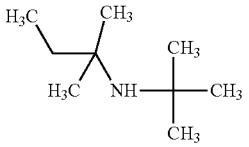

N-tert-butylheptan-2-amine:

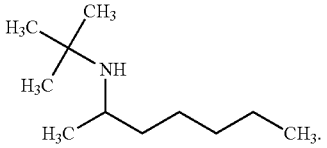

The sterically hindered amine compound may alternatively be exemplified by the general formula (VIII):

(VIII)

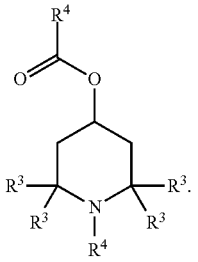

In general formula (VIII), each $R^3$ and $R^4$ are as described above, wherein at least three of $R^3$ are each independently an alkyl group. The sterically hindered amine compound of general formula (VIII) may be exemplified by the following compounds:

(1,2,2,6,6-pentamethyl-4-piperidyl) octanoate:

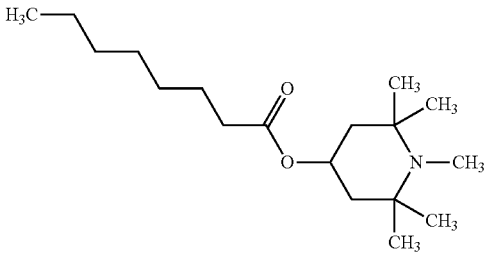

(1,2,2,6,6-pentamethyl-4-piperidyl) decanoate:

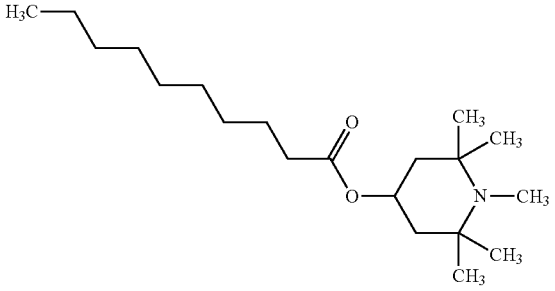

-continued (1,2,2,6,6-pentamethyl-4-piperidyl) dodecanoate:

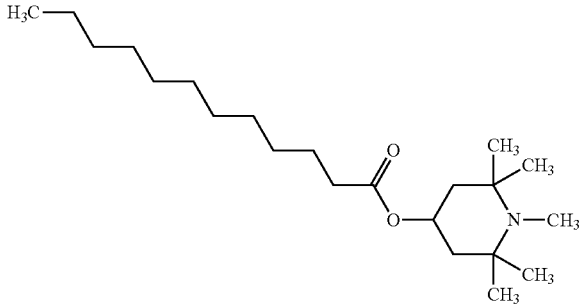

(2,2,6,6-tetramethyl-4-piperidyl) dodecanoate:

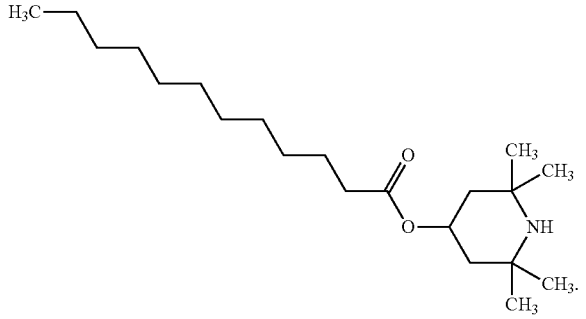

The sterically hindered amine compound may include a single ester group. However, the sterically hindered amine compound may alternatively be free from ester groups. In certain embodiments, the sterically hindered amine compound may include at least one, or only one, piperidine ring.

If utilized, the lubricant composition includes the amine compound such as the sterically hindered amine compound, in an amount of from 0.1 to 25, 0.1 to 20, 0.1 to 15, or 0.1 to 10, wt. %, based on the total weight of the lubricant composition. Alternatively, the lubricant composition may include the amine compound in an amount of from 0.5 to 5, 1 to 3, or 1 to 2, wt. %, based on the total weight of the lubricant composition.

If the amine compound is included in the additive package, the additive package includes the amine compound, such as the sterically hindered amine compound, in an amount of from 0.1 to 50 wt. %, based on the total weight of the additive package. Alternatively, the additive package may include the amine compound in an amount of from 1 to 25, 0.1 to 15, 1 to 10, 0.1 to 8, or 1 to 5, wt. %, based on the total weight of the additive package. Combinations of various amine compounds are also contemplated.

The lubricant composition or the additive package may further include a dispersant in addition to the seal compatibility additive and/or the amine compound. The dispersant may be a polyalkene amine or other amine dispersant. As such, depending on the composition of the dispersant, the dispersant may be encompassed by at least one of the descriptions of the amine compound provided above.

The TBN value of the amine dispersant may be least 15, at least 25, or at least 30, mg KOH/g of the amine dispersant. Alternatively, the TBN value of the amine dispersant may range from 15 to 100, from 15 to 80, or from 15 to 75, mg KOH/g of the amine dispersant.

The polyalkene amine includes a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methyl butene, 1-hexene, 2-methylpentene, 3-methylpentene, and 4-methylpentene. The polyalkene moiety has a weight average molecular weight of from 200 to 10000, 500 to 10000, or 800 to 5000.

In one embodiment, the polyalkene amine is derived from polyisobutenes. Particularly suitable polyisobutenes are known as "highly reactive" polyisobutenes which feature a high content of terminal double bonds. Terminal double bonds are alpha-olefinic double bonds of the type shown in general formula (IX):

(IX)

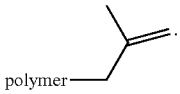

The bonds shown in general formulas (IX) are known as vinylidene double bones. Suitable highly reactive polypolyisobutenes are, for example, polyisobutenes which have a fraction of vinylidene double bonds of greater than 70, 80, or 85, mole %. Preference is given in particular to polyisobutenes which have uniform polymer frameworks. Uniform polymer frameworks have in particular those polyisobutenes which are composed of at least 85, 90, or 95, wt. %, of isobutene units. Such highly reactive polyisobutenes preferably have a number-average molecular weight in the abovementioned range. In addition, the highly reactive polyisobutenes may have a polydispersity of from 1.05 to 7, or 1.1 to 2.5. The highly reactive polyisobutenes may have a polydispersity less than 1.9, or less than 1.5. Polydispersity refers to the quotients of weight-average molecular weight Mw divided by the number-average molecular weight Mn.

The amine dispersant may include moieties derived from succinic anhydride and having hydroxyl and/or amino and/or amido and/or imido groups. For example, the dispersant may be derived from polyisobutenylsuccinic anhydride which is obtainable by reacting conventional or highly reactive polyisobutene having a weight average molecular weight of from 500 to 5000 with maleic anhydride by a thermal route or via the chlorinated polyisobutene. For examples, derivatives with aliphatic polyamines such as ethylenediamine, diethylenetriamine, triethylenetetramine or tetraethylenepentamine may be used.

To prepare the polyalkene amine, the polyalkene component may be aminated in a known manner. An exemplary process proceeds via the preparation of an oxo intermediate by hydroformylation and subsequent reductive amination in the presence of a suitable nitrogen compound.

The dispersant may be a poly(oxyalkyl) radical or a polyalkylene polyamine radical of the general formula (X):

$$R^7\text{—NH—}(C_1\text{-}C_6\text{-alkylene-NH})_m\text{—}C_1\text{-}C_6\text{-alkylene} \quad (X)$$

where m is an integer of from 1 to 5, $R^7$ is a hydrogen atom or a hydrocarbyl group having from 1 to 6 carbon atoms with $C_1$-$C_6$ alkylene representing the corresponding bridged analogs of the alkyl radicals. The dispersant may also be a polyalkylene imine radical composed of from 1 to 10 $C_1$-$C_4$ alkylene imine groups; or, together with the nitrogen atom to which they are bonded, are an optionally substituted 5- to 7-membered heterocyclic ring which is optionally substituted by one to three $C_1$-$C_4$ alkyl radicals and optionally bears one further ring heteroatom such as oxygen or nitrogen.

Examples of suitable alkenyl radicals include mono- or polyunsaturated, preferably mono- or diunsaturated analogs of alkyl radicals has from 2 to 18 carbon atoms, in which the double bonds may be in any position in the hydrocarbon chain. Examples of $C_4$-$C_{18}$ cycloalkyl radical include cyclobutyl, cyclopentyl and cyclohexyl, and also the analogs thereof substituted by 1 to 3 $C_1$-$C_4$ alkyl radicals. The $C_1$-$C_4$ alkyl radicals are, for example, selected from methyl, ethyl, iso- or n-propyl, n-, iso-, sec- or tert-butyl. Examples of the arylalkyl radical include a $C_1$-$C_{18}$ alkyl group and an aryl group which are derived from a monocyclic or bicyclic fused or nonfused 4- to 7-membered, in particular 6 membered, aromatic or heteroaromatic group, such as phenyl, pyridyl, naphthyl and biphenyl.

If additional dispersants other than the dispersant described above are employed, these dispersants can be of various types. Suitable examples of dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof.

If employed, the dispersant can be used in various amounts. The dispersant may be present in the lubricant composition in an amount of from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, each based on the total weight of the lubricant composition. The amounts may be in addition to the amounts of the amine compound utilized in the lubricant composition and/or the additive package.

In the additive package, the total weight of the dispersant and the seal compatibility additive is less than 50, less than 45, less than 40, less than 35, or less than 30, wt. %, of the additive package based on the total weight of the additive package.

As described above, the lubricant composition may include the base oil. The base oil may be classified in accordance with the American Petroleum Institute (API) Base Oil Interchangeability Guidelines. In other words, the base oil may be further described as at least one of five types of base oils: Group I (sulphur content >0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

In some embodiments, the base oil is selected from the group of API Group I base oils; API Group II base oils; API Group III base oils; API Group IV base oils; API Group V base oils; and combinations thereof. In one embodiment, the base oil includes API Group II base oils. In certain embodiments, the lubricant composition is free of Group I, Group II, Group III, Group IV, Group V, base oils and/or combinations thereof.

The base oil may have a viscosity of from 1 to 50, 1 to 40, 1 to 30, 1 to 25, or 1 to 20, cSt, when tested according to ASTM D445 at 100° C. Alternatively, the viscosity of the base oil may range from 3 to 17, or 5 to 14, cSt, when tested according to ASTM D445 at 100° C.

The base oil may be further defined as a crankcase lubricant oil for spark-ignited and compression-ignited internal combustion engines, including automobile and truck engines, two-cycle engines, aviation piston engines, marine engines, and railroad diesel engines. Alternatively, the base oil can be further defined as an oil to be used in gas engines, diesel engines, stationary power engines, and turbines. The base oil may be further defined as heavy or light duty engine oil.

In some embodiments, the lubricant composition is a 'wet' lubricant composition that includes at least one liquid component. The lubricant composition is not a dry lubricant as it requires at least one liquid component to properly lubricate.

In still other embodiments, the base oil may be further defined as synthetic oil that includes at least one alkylene oxide polymers and interpolymers, and derivatives thereof. The terminal hydroxyl groups of the alkylene oxide polymers may be modified by esterification, etherification, or similar reactions. Typically, these synthetic oils are prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having a weight average molecular weight of 1000; diphenyl ether of polyethylene glycol having a molecular weight of 500-1000; or diethyl ether of polypropylene glycol having a weight average molecular weight of 1,000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil. Alternatively, the base oil may include a substantially inert, normally liquid, organic diluent, such as mineral oil, naptha, benzene, toluene, or xylene.

The base oil may include less than 90, less than 80, less than 70, less than 60, less than 50, less than 40, less than 30, less than 20, less than 10, less than 5, less than 3, less than 1, or be free from, an estolide compound (i.e., a compound including at least one estolide group), based on the total weight of the lubricant composition.

The base oil may be present in the lubricant composition in an amount of from 1 to 99.9, 50 to 99.9, 60 to 99.9, 70 to 99.9, 80 to 99.9, 90 to 99.9, 75 to 95, 80 to 90, or 85 to 95, wt. %, based on the total weight of the lubricant composition. Alternatively, the base oil may be present in the lubricant composition in amounts of greater than 1, 10, 20, 30, 40, 50, 60, 70, 75, 80, 85, 90, 95, 98, or 99, wt. %, based on the total weight of the lubricant composition. In various embodiments, the amount of base oil in a fully formulated lubricant composition (including diluents or carrier oils present) ranges from 50 to 99, 60 to 90, 80 to 99.5, 85 to 96, or 90 to 95, wt. %, based on the total weight of the lubricant composition. Alternatively, the base oil may be present in the lubricant composition in an amount of from 0.1 to 50, 1 to 25, or 1 to 15, wt. %, based on the total weight of the lubricant composition. In various embodiments, the amount of base oil in an additive package, if included, (including diluents or carrier oils present) ranges from 0.1 to 50, 1 to 25, or 1 to 15, wt. %, based on the total weight of the additive package.

In one or more embodiments, the lubricant composition may be classified as a low SAPS lubricant having a sulfated ash content of no more than 3, 2, 1, or 0.5, wt. %, based on the total weight of the lubricant composition. "SAPS" refers to sulfated ash, phosphorous and sulfur.

The lubricant composition may have a TBN value of at least 1, at least 3, at least 5, at least 7, at least 9, mg KOH/g of lubricant composition, when tested according to ASTM D2896. Alternatively, the lubricant composition has a TBN value of from 3 to 100, 3 to 75, 50 to 90, 3 to 45, 3 to 35, 3 to 25, 3 to 15, or 9 to 12, mg KOH/g of lubricant composition, when tested according to ASTM D2896.

In certain embodiments, the lubricant composition is a multigrade lubricant composition identified by the viscometric descriptor SAE15WX, SAE 10WX, SAE 5WX or SAE 0WX, where X is 8, 12, 16, 20, 30, 40, or 50. The characteristics of at least one of the different viscometric grades can be found in the SAE J300 classification.

The lubricant composition may have a phosphorus content of less than 1500, less than 1200, less than 1000, less than 800, less than 600, less than 400, less than 300, less than 200, or less than 100, or 0, ppm, as measured according to the ASTM D5185 standard, or as measured according to the ASTM D4951 standard. The lubricant composition may have a sulfur content of less than 3000, less than 2500, less than 2000, less than 1500, less than 1200, less than 1000, less than 700, less than 500, less than 300, or less than 100, ppm, as measured according to the ASTM D5185 standard, or as measured according to the ASTM D4951 standard.

Alternatively, the lubricant composition may have a phosphorous content of from 1 to 1000, 1 to 800, 100 to 700, or 100 to 600, ppm, as measured according to the ASTM D5185 standard.

The lubricant composition may be free from, or substantially free from, a carboxylic acid ester and/or phosphate ester. For example, the lubricant composition may include less than 20, less than 15, less than 10, less than 5, less than 3, less than 1, less than 0.5, or less than 0.1, wt. %, carboxylic acid ester and/or phosphate ester. The carboxylic acid ester and/or phosphate ester may be included as conventional base oil in water-reactive functional fluids. The lubricant composition may be free from a carboxylic acid ester base oil and/or phosphate ester base oil, which are liquid at a steady state temperature of 25° C. and a steady state pressure of 1 atmosphere.

The lubricant composition may be unreactive with water. By unreactive with water, it is meant that less than 5, 4, 3, 2, 1, 0.5, or 0.1, wt. %, of the lubricant composition reacts with water at 1 atmosphere of pressure and 25° C.

In various embodiments, the additive package is substantially free of water, e.g., the additive package includes less than 5, 4, 3, 2, 1, 0.5, or 0.1, wt. %, of water based on the total weight of the additive package. Alternatively, the additive package may be completely free of water. Similarly, the lubricant composition may be substantially free of water, e.g., the lubricant composition includes less than 5, less than 4, less than 3, less than 2, less than 1, less than 0.5, or less than 0.1, wt. %, of water based on the total weight of the lubricant composition.

In various embodiments, the lubricant composition is substantially free of water, e.g., the lubricant composition includes less than 5, less than 4, less than 3, less than 2, less than 1, less than 0.5, or less than 0.1, wt. %, of water, based on the total weight of the lubricant composition. Alternatively, the lubricant composition may be completely free of water.

The lubricant composition may include less than 50, less than 25, less than 10, less than 5, less than 1, less than 0.1, or less than 0.01, wt. %, of a fluorinated base oil, or the lubricant composition may be free from a fluorinated base oil. The fluorinated base oil may include any fluorinated oil component, such as perfluoropolyethers. Exemplary perfluoropolyethers are described below:

$CF_3CF_2CF_2—O—[CF(CF_3)CF_2—O]_nCF_2CF_3$, $CF_3O[CF(CF_3)CF_2—O]_y—[CF_2—O]_mCF_3$, $CF_3O[CF_2CF_2—O—]_x—[CF_2—O—]_pCF_3$, $CF_3CF_2CF_2—O—[CF_2CF_2CF_2—O—]_qCF_2CF_3$, and halocarbons containing the repeating group —$(CF_2CFCl)_r$, where n is an integer from 0 to 60; y is an integer from 0 to 60; m is an integer from 0 to 60; z is an integer from 0 to 60; p is an integer from 0 to 60; q is an integer from 0 to 60; and r is an integer from 2 to 10.

In certain embodiments, the fluorinated base oil component may also be generally defined as any component that includes more than 5, 10, 15, or 20 fluorine atoms per molecule.

In one embodiment, the lubricant composition passes ASTM D4951 for phosphorus content. ASTM D4951 is a standard test method for determination of additive elements in lubricant compositions by inductively coupled plasma atomic emission spectrometry (ICP-OES).

In another embodiment, the lubricant composition passes ASTM D6795, which is a standard test method for measuring the effect on filterability of lubricant compositions after treatment with water and dry ice and a short (30 min) heating time. ASTM D6795 simulates a problem that may be encountered in a new engine run for a short period of time, followed by a long period of storage with some water in the oil. ASTM D6795 is designed to determine the tendency of a lubricant composition to form a precipitate that can plug an oil filter.

In another embodiment, the lubricant composition passes ASTM D6794, which is a standard test method for measuring the effect on filterability of lubricant composition after treatment with various amounts of water and a long (6 h) heating time. ASTM D6794 simulates a problem that may be encountered in a new engine run for a short period of time, followed by a long period of storage with some water in the oil. ASTM D6794 is also designed to determine the tendency of the lubricant composition to form a precipitate that can plug an oil filter.

In another embodiment, the lubricant composition passes ASTM D6922, which is a standard test method for determining homogeneity and miscibility in lubricant compositions. ASTM D6922 is designed to determine if a lubricant composition is homogeneous and will remain so, and if the lubricant composition is miscible with certain standard reference oils after being submitted to a prescribed cycle of temperature changes.

In another embodiment, the lubricant composition passes ASTM D5133, which is a standard test method for low temperature, low shear rate, viscosity/temperature dependence of lubricating oils using a temperature-scanning technique. The low-temperature, low-shear viscometric behavior of a lubricant composition determines whether the lubricant composition will flow to a sump inlet screen, then to an oil pump, then to sites in an engine requiring lubrication in sufficient quantity to prevent engine damage immediately or ultimately after cold temperature starting.

In another embodiment, the lubricant composition passes ASTM D5800 and/or ASTM D6417, both of which are test methods for determining an evaporation loss of a lubricant composition. The evaporation loss is of particular importance in engine lubrication, because where high temperatures occur, portions of a lubricant composition can evaporate and thus alter the properties of the lubricant composition.

In another embodiment, the lubricant composition passes ASTM D6557, which is a standard test method for evaluation of rust preventive characteristics of lubricant compositions. ASTM D6557 includes a Ball Rust Test (BRT) procedure for evaluating the anti-rust ability of lubricant compositions. This BRT procedure is particularly suitable for the evaluation of lubricant compositions under low-temperature and acidic service conditions.

In another embodiment, the lubricant composition passes ASTM D4951 for sulfur content. ASTM D4951 is a standard test method for determination of additive elements in lubricant compositions by ICP-OES. In addition, the lubricant composition also passes ASTM D2622, which is a standard test method for sulfur in petroleum products by wavelength dispersive x-ray fluorescence spectrometry.

In another embodiment, the lubricant composition passes ASTM D6891, which is a standard test method for evaluating a lubricant composition in a sequence IVA spark-ignition engine. ASTM D6891 is designed to simulate extended engine idling vehicle operation. Specifically, ASTM D6891 measures the ability of a lubricant composition to control camshaft lobe wear for spark-ignition engines equipped with an overhead valve-train and sliding cam followers.

In another embodiment, the lubricant composition passes ASTM D6593, which is a standard test method for evaluating lubricant compositions for inhibition of deposit formation in a spark-ignition internal combustion engine fueled with gasoline and operated under low-temperature, light-duty conditions. ASTM D6593 is designed to evaluate a lubricant composition's control of engine deposits under operating conditions deliberately selected to accelerate deposit formation.

In another embodiment, the lubricant composition passes ASTM D6709, which is a standard test method for evaluating lubricant compositions in a sequence VIII spark-ignition engine. ASTM D6709 is designed to evaluate lubricant compositions for protection of engines against bearing weight loss.

In yet another embodiment, the lubricant composition passes ASTM D6984, which is a standard test method for evaluation of automotive engine oils in the Sequence IIIF, Spark-Ignition. In other words, the viscosity increase of the lubricant composition at the end of the test is less than 275% relative to the viscosity of the lubricant composition at the beginning of the test.

In another embodiment, the lubricant composition passes two, three, four, or more of the following standard test methods: ASTM D4951, ASTM D6795, ASTM D6794, ASTM D6922, ASTM D5133, ASTM D6557, ASTM D6891, ASTM D2622, ASTM D6593, and ASTM D6709.

The lubricant composition may be a lubricant composition, such as a crankcase lubricant composition, having a total additive treat rate of at least 3, at least 4, at least 5, at least 6, at least 7, or at least 8, wt. %, based on a total weight of the lubricant composition. Alternatively, the lubricant composition may have a total additive treat rate ranging from 3 to 20, 4 to 18, 5 to 16, or 6 to 14, wt. %, based on a total weight of the lubricant composition. The term "total additive treat rate" refers to the total weight percentage of additives included in the lubricant composition. The additives accounted for in the total additive treat rate include, but are not limited to, seal compatibility additives, amine compounds, non-amine dispersants, detergents, aminic antioxidants, phenolic antioxidants, anti-foam additives, antiwear additives, pour point depressants, viscosity modifiers, and combinations thereof. In certain embodiments, an additive is any compound in the lubricant composition other than the base oil. In other words, the total additive treat rate calculation does not account for the base oil as an additive.

The additive package may include, but is not limited to, seal compatibility additives, amine compounds, dispersants, detergents, aminic antioxidants, phenolic antioxidants, anti-foam additives, antiwear additives, pour point depressants, viscosity modifiers, and combinations thereof. The lubricant composition may include the additive package in amount of, at least 0.1, at least 1, at least 2, at least 3, at least 4, at least 5, at least 6, at least 7, or at least 8, wt. %, based on a total weight of the lubricant composition. Alternatively, the lubricant composition may include the additive package in an amount of from 0.1 to 5, 0.5 to 10, 1 to 5, 3 to 20, 4 to 18, 5 to 16, or 6 to 14, wt. %, based on a total weight of the lubricant composition. In some embodiments, the additive package does not account for the weight of the base oil as an additive. Although not required, the additive package includes all compounds in the lubricant composition other than the base oil. However, it is to be appreciated that certain individual components can be independently and individually added to the lubricant composition separate from the addition of the additive package to the lubricant composition, yet still be considered part of the additive package once the additive which was individually added into the lubricant composition is present in the lubricant composition along with the other additives.

The additive package refers to the collective amount of the seal compatibility additives, amine compounds, dispersants, detergents, aminic antioxidants, phenolic antioxidants, anti-foam additives, antiwear additives, pour point depressants, viscosity modifiers, or combinations thereof in a solution, mixture, concentrate, or blend, such as the lubricant composition. In some embodiments, the term "additive package" does not require that these additives are physically packaged together or blended together before addition to the base oil. Thus, a base oil which includes the seal compatibility additive and the dispersant, each added to the base oil separately, could be interpreted to be a lubricant composition that includes an additive package including the seal compatibility additive and the dispersant. In other embodiments, the additive package refers to a blend of the seal compatibility additives, amine compounds, dispersants, detergents, aminic antioxidants, phenolic antioxidants, anti-foam additives, antiwear additives, pour point depressants, viscosity modifiers, or combinations thereof. The additive package may be blended into the base oil to make the lubricant composition.

The additive package may be formulated to provide the desired concentration in the lubricant composition when the additive package is combined with a predetermined amount of base oil. It is to be appreciated that most references to the lubricant composition throughout this disclosure also apply to the description of the additive package. For example, it is to be appreciated that the additive package may include, or exclude, the same components as the lubricant composition, albeit in different amounts.

The lubricant composition may consist, or consist essentially of, a base oil, a seal compatibility additive, such a seal compatibility additive including at least an iodine atom, and an amine compound, such a sterically hindered amine compound. It is also contemplated that the lubricant composition may consist of, or consist essentially of, the base oil, the seal compatibility additive, and the amine compound, in addition to at least one of the additives that do not materially affect the functionality or performance of the seal compatibility additive. For example, compounds that materially affect the overall performance of the lubricant composition may include compounds which impact the TBN boost, the lubricity, the fluoropolymer seal compatibility, the corrosion inhibition, or the acidity of the lubricant composition.

In other embodiments, the additive package may consist, or consist essentially of, the seal compatibility additive, or consist, or consist essentially of the seal compatibility additive and the amine compound. It is also contemplated that the additive package may consist of, or consist essentially of, the seal compatibility additive, and the amine compound in addition to at least one of the additives that do not compromise the functionality or performance of the seal compatibility additive. When used in reference to the additive package, the term "consisting essentially of" refers to the additive package being free of compounds that materially affect the overall performance of the additive package. For example, compounds that materially affect the overall performance of the additive package may include compounds which impact the TBN boost, the lubricity, the fluoropolymer seal compatibility, the corrosion inhibition, or the acidity of the additive package.

The additive package may include the seal compatibility additive and the amine compound in a weight ratio ranging from 1:100 to 10:1, from 1:80 to 2:1; from 1:50 to 10:1, or from 1:10 to 10:1. Alternatively, the additive package may include the seal compatibility additive and the amine compound in a weight ratio ranging from 1:3 to 1:6. More specifically, the additive package may include the seal compatibility additive and the sterically hindered amine in a weight ratio ranging from 1:10 to 10:1, or a weight ratio ranging from 1:3 to 1:6.

The lubricant composition or the additive package may further include an antiwear additive, optionally including phosphorous. The antiwear additive may include sulfur- and/or phosphorus- and/or halogen-containing compounds, e.g., sulfurised olefins and vegetable oils, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof, diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof.

In some embodiments, the antiwear additive including phosphorous may be exemplified by a dihydrocarbyl dithiophosphate salt. The dihydrocarbyl dithiophosphate salt may be represented by the following general formula (XI):

$$[R^8O(R^9O)PS(S)]_2M \quad \text{(XI)}$$

where $R^8$ and $R^9$ are each hydrocarbyl groups independently having from 1 to 30, 1 to 20, 1 to 15, 1 to 10, or 1 to 5, carbon atoms, wherein M is a metal atom or an ammonium group. For example, $R^8$ and $R^9$ may each independently be $C_{1-20}$ alkyl groups, $C_{2-20}$ alkenyl groups, $C_{3-20}$ cycloalkyl groups, $C_{1-20}$ aralkyl groups or $C_{3-20}$ aryl groups. The groups designated by $R^8$ and $R^9$ may be substituted or unsubstituted. The hydrocarbyl groups designated by $R^8$ and $R^9$ groups may have the same meaning as described above with respect to R in general formula (II). The metal atom may be selected from the group including aluminum, lead, tin, manganese, cobalt, nickel, or zinc. The ammonium group may be derived from ammonia or a primary, secondary, or tertiary amine. The ammonium group may be of the formula $R^{10}R^{11}R^{12}R^{13}N^+$, wherein $R^{10}$, $R^{11}$, $R^{12}$, and $R^{13}$ each independently represents a hydrogen atom or a hydrocarbyl group having from 1 to 150 carbon atoms. In certain embodiments, $R^{10}$, $R^{11}$, $R^{12}$, and $R^{13}$ may each independently be hydrocarbyl groups having from 4 to 30 carbon atoms. The hydrocarbyl groups designated by $R^{10}$, $R^{11}$, $R^{12}$, and $R^{13}$ may have the same meaning and R in general formula (II). In one embodiment, the dihydrocarbyl dithiophosphate salt is zinc dialkyl dithiophosphate. The lubricant composition may include mixtures of different dihydrocarbyl dithiophosphate salts In certain embodiments, the dihydrocarbyl dithiophosphate salt includes a mixture of primary and secondary alkyl groups for, $R^8$ and $R^9$, wherein the secondary alkyl groups are in a major molar proportion, such as at least 60, at least 75, or at least 85, mole %, based on the number of moles of alkyl groups in the dihydrocarbyl dithiophosphate salt.

In some embodiments, the antiwear additive may be ashless. The antiwear additive may be further defined as a phosphate. In another embodiment, the antiwear additive is further defined as a phosphite. In still another embodiment, the antiwear additive is further defined as a phosphorothionate. The antiwear additive may alternatively be further defined as a phosphorodithioate. In one embodiment, the antiwear additive is further defined as a dithiophosphate. The antiwear additive may also include an amine such as a secondary or tertiary amine. In one embodiment, the antiwear additive includes an alkyl and/or dialkyl amine. Structures of suitable non-limiting examples of antiwear additives are set forth immediately below:

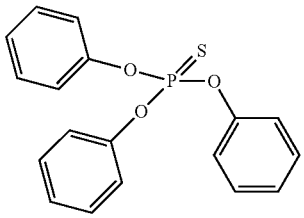

Triphenyl Phosphorothionate

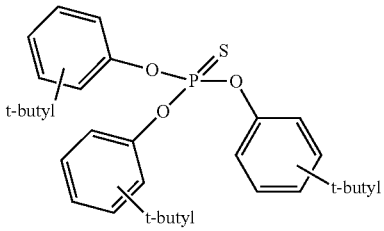

Butylated Triphenyl Phosphorothionate

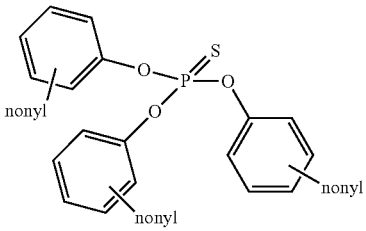

Nonyl Triphenyl Phosphorothionate

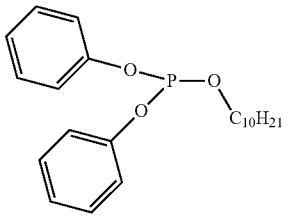

Decyl Diphenylphosphite

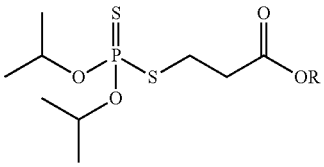

Neutral Dialkyl Dithiophosphate

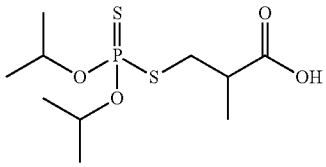

Acidic Dialkyl Dithiophosphate

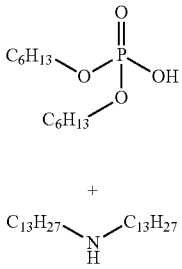

Amine Phosphate + Ditridecyl Amine

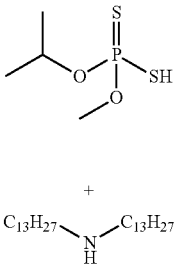

Isopropyl Phosphorodithioate + Ditridecyl Amine

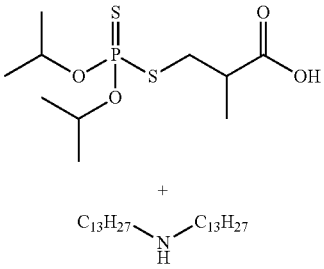

Acidic Dialkyl Dithiophosphate + Ditridecyl Amine

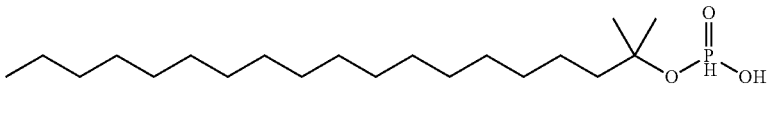

Dimethyloctadecyl Phosphonate

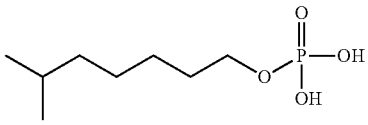

Iso-Octyl Phosphate + $C_{12}$-$C_{14}$ Amine

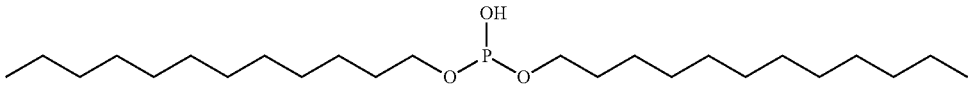

Dilauryl Hydrogen Phosphite

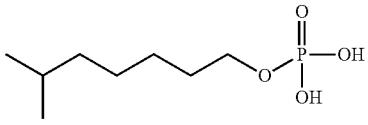

Iso-Octyl Phosphate + $C_{12}$-$C_{14}$ Amine

-continued

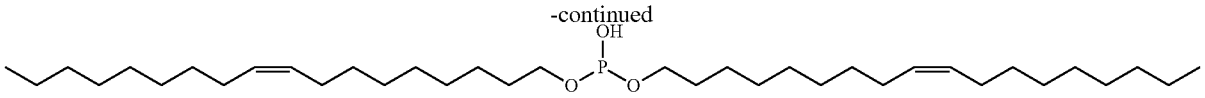

Dioleyl Hydrogen Phosphite

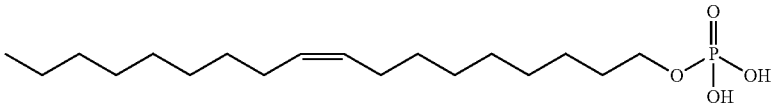

Oleyl Phosphate

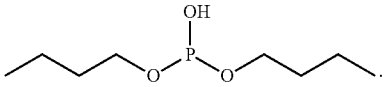

Dibutyl Hydrogen Phosphite

The antiwear additive, such as the antiwear agent including phosphorous, can be present in the lubricant composition in an amount of from 0.1 to 20, 0.5 to 15, 1 to 10, 0.1 to 5, 0.1 to 1, 0.1 to 0.5, or 0.1 to 1.5, wt. %, each based on the total weight of the lubricant composition. Alternatively, the antiwear additive may be present in amounts of less than 20, less than 10, less than 5, less than 1, less than 0.5, or less than 0.1, wt. %, each based on the total weight of the lubricant composition. The additive package may also include the antiwear additive including phosphorous in an amount of from 0.1 to 20, 0.5 to 15, 1 to 10, 0.1 to 5, 0.1 to 1, 0.1 to 0.5, or 0.1 to 1.5, wt. %, each based on the total weight of the additive package.

The additive package or lubricant composition may additionally include at least one additive other than those described above to improve various chemical and/or physical properties of the resultant lubricant composition. Specific examples of the additives include antioxidants, metal deactivators (or passivators), rust inhibitors, viscosity index improvers, pour point depressors, dispersants, detergents, and antifriction additives. Each of the additives may be used alone or in combination. The additive(s) can be used in various amounts, if employed. The additive package or lubricant composition may be a rust and oxidation lubricant formulation, a hydraulic lubricant formulation, turbine lubricant formulation, and an internal combustion engine lubricant formulation.

If employed, the antioxidant can be of various types. Suitable antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example, 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example, 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl) adipate, and combinations thereof, may also be utilized.

Furthermore, hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol),1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl) butane, 1,1-bis (5-tert-butyl-4-hydroxy-2-methyl-phenyl)-3-n-dodecylmercapto butane, ethylene glycol bis[3,3-bis(3'-tert-butyl-4'-hydroxyphenyl)butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O-, N- and S-benzyl compounds, for example 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate, and combinations thereof are also suitable for use as antioxidants.

Triazine compounds, for example, 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris (3,5-di-tert-butyl-4-hydroxyphenyl propionyl)-hexahydro-1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl) phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl3,5-di-tert-butyl-4-hydroxybenzylphosphonate, dioctadecyl-5-tert-butyl-4-hydroxy3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo [2.2.2]octane, and combinations thereof, may also be used. It is further contemplated that esters of β-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl) isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo octane, and combinations thereof, may be used.

Additional examples of suitable antioxidants include those that include nitrogen, such as amides of β-(3,5-di-tert-butyl-4-hydroxyphenyl)propionic acid, e.g., N,N-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino)propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N-tetraphenyl-1,4-diaminobut-2-ene, N,N-bis(2,2,6,6-tetramethylpiperid-4-yl-hexamethylenediamine, bis(2,2,6,6-tetramethyl piperid-4-yl)sebacate, 2,2,6,6-tetramethylpiperidin-4-one and 2,2,6,6-tetramethyl piperidin-4-ol, and combinations thereof.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiatridecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant may be present in the additive package in an amount ranging from 0.1 to 99, from 1 to 70, from 5 to 50, or from 25 to 50, wt. %, based on the total weight of the additive package. The antioxidant is typically present in the lubricant composition in an amount ranging from 0.01 to 5, from 0.1 to 3, or from 0.5 to 2, wt. %, based on the total weight of the lubricant composition.

If employed, the metal deactivator can be of various types. Suitable metal deactivators include benzotriazoles and derivatives thereof, for example 4- or 5 alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl) tolutriazole, and combinations thereof.

Additional examples of suitable metal deactivators include 1,2,4-triazoles and derivatives thereof, for example 3 alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl] carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator may be present in the additive package in an amount ranging from 0.1 to 99, from 1 to 70, from 5 to 50, or from 25 to 50, wt. %, based on the total weight of the additive package. The metal deactivator is typically present in the lubricant composition in an amount ranging from 0.01 to 0.1, from 0.05 to 0.01, or from 0.07 to 0.1, wt. %, based on the total weight of the lubricant composition.

If employed, the rust inhibitor and/or friction modifier can be of various types. Suitable examples of rust inhibitors and/or friction modifiers include organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example, dodecenylsuccinic anhydride, 2-carboxymethyl-1-dodecyl-3-methylglycerol and the amine salts thereof, and combinations thereof. Additional examples include nitrogen-containing compounds, for example, primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy) propan-2-ol, and combinations thereof. Further examples include heterocyclic compounds, such as substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, molybdenum containing compounds, such as molydbenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl) glycerols and 2-carboxyalkyl-1,3-dialkylglycerols, and combinations thereof.

If employed, the rust inhibitor and/or friction modifier can be used in various amounts. The rust inhibitor and/or friction modifier may be present in the additive package in an amount ranging from 0.01 to 0.1, from 0.05 to 0.01, or from 0.07 to 0.1, wt. %, based on the total weight of the additive package. The rust inhibitor and/or friction modifier is typically present in the lubricant composition in an amount ranging from 0.01 to 0.1, from 0.05 to 0.01, or from 0.07 to 0.1, wt. %, based on the total weight of the lubricant composition.

If employed, the viscosity index improver (VII) can be of various types. Suitable examples of VIIs include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the VII can be used in various amounts. The VII may be present in the additive package in an amount ranging from 0.01 to 20, from 1 to 15, or from 1 to 10, wt. %, based on the total weight of the additive package. The VII is typically present in the lubricant composition in an amount ranging from 0.01 to 20, from 1 to 15, or from 1 to 10, wt. %, based on the total weight of the lubricant composition.

If employed, the pour point depressant can be of various types. Suitable examples of pour point depressants include polymethacrylate and alkylated naphthalene derivatives, and combinations thereof.

If employed, the pour point depressant can be used in various amounts. The pour point depressant may be present in the additive package in an amount ranging from 0.1 to 99, from 1 to 70, from 5 to 50, or from 25 to 50, wt. %, based on the total weight of the additive package. The pour point depressant is typically present in the lubricant composition in an amount ranging from 0.01 to 0.1, from 0.05 to 0.01, or from 0.07 to 0.1, wt. %, each based on the total weight of the lubricant composition.

If employed, the detergent can be of various types. Suitable examples of detergents include overbased or neutral metal sulphonates, phenates and salicylates, and combinations thereof.

If employed, the detergent can be used in various amounts. The detergent is typically present in the additive package in an amount ranging from 0.1 to 99, from 1 to 70, from 5 to 50, or from 25 to 50, wt. %, based on the total weight of the additive package. The detergent is typically present in the lubricant composition in an amount ranging from 0.01 to 5, from 0.1 to 4, from 0.5 to 3, or from 1 to 3, wt. %, based on the total weight of the lubricant composition. Alternatively, the detergent may be present in amounts of less than 5, less than 4, less than 3, less than 2, or less than 1, wt. %, based on the total weight of the lubricant composition.

Lubricant compositions provided for use and used pursuant to this invention include those which pass the CEC L-39-T96 seal compatibility test. As described above, the additive package may be used to formulate the lubricant composition which passes the CEC L-39-T96 seal compatibility test. The CEC L-39-T96 test involves keeping a test specimen of a fluoropolymer seal in a lubricant composition at 150° C. The seal specimens are then removed and dried and the properties of the seal specimens are assessed and compared to the seal specimens which were not heated in the lubricant composition. The percent change in these properties is assessed to quantify the compatibility of the fluoropolymer seal with the lubricant composition. The incorporation of the seal compatibility additive into the lubricant composition decreases the tendency of the lubricant composition to degrade the seals versus lubricant compositions which are free from the seal compatibility additive.

The pass/fail criteria include maximum variation of certain characteristics after immersion for 7 days in fresh oil without pre-aging. The maximum variation for each characteristic depends on the type of elastomer used, the type of engine used, and whether an aftertreatment device is utilized.

The characteristics measured before and after immersion included Hardness DIDC (points); Tensile Strength (%);

Elongation at Rupture (%); and Volume Variation (%). For heavy-duty diesel engines, the pass/fail criteria are presented below in Table 1:

TABLE 1

Fluoropolymer Seal Compatibility for CEC L-39-T96 Heavy-Duty Diesel Engines

| Property | Elastomer Type RE1 |
|---|---|
| Hardness DIDC, points | −1/+5 |
| Tensile Strength, % | −50/+10 |
| Elongation at Rupture, % | −60/+10 |
| Volume Variation, % | −1/+5 |

In these tests, a lubricant composition passes the test if the exposed test specimen exhibits a change in hardness from −1% to +5%; a change in tensile strength (as compared to an untested specimen) from −50% to +10%; a change in elongation at rupture (as compared to an untested specimen) from −60% to +10%; and a change in volume variation (as compared to an untested specimen) from −1% to +5%. In one or more embodiments, the lubricant composition passes the CEC L-39-T96 test parameters outlined above.

When the lubricant composition is tested according to CEC L-39-T96 for Heavy-Duty Diesel Engines, the change in hardness can range from −1 to 5, from −0.5 to 5, from −0.1 to 5, from 0.5 to 5, or from 1 to 5, %; the change in tensile strength can range from −20 to 10, from −10 to 10, from −5 to 10, or from −3 to 5, %; the change in elongation at rupture can range from −30 to 10, from −20 to 10, from −10 to 5, or from −10 to 1, %; and the change in volume variation can range from −1 to 5%, −0.75 to 5%, −0.5 to 5%, −0.1 to 5%, or 0 to 5%.

Furthermore, the seal compatibility additive also does not negatively affect the TBN values of the additive package or lubricant composition. The TBN value of the additive package or lubricant composition can be determined according to ASTM D2896 and ASTM D4739. TBN is an industry standard measurement used to correlate the basicity of any material to that of potassium hydroxide.

The seal compatibility additive may not significantly affect the corrosion inhibition of the lubricant composition, or may improve the corrosion inhibition of the lubricant composition. The corrosion inhibition may be measured according to ASTM D6954.

Some of the compounds described above may interact in the lubricant composition, so that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

A method of lubricating a system is also provided. The method includes contacting the system with the lubricant composition described above. The system may include an internal combustion engine. Alternatively, the system may further include any combustion engine or application that utilizes the lubricant composition. The system includes a fluoropolymer seal.

The fluoropolymer seal may include a fluoroelastomer. The fluoroelastomer may be categorized under ASTM D1418 and ISO 1629 designation of FKM for example. FKM is fluoro-rubber of the polymethylene type having substituent fluoro and perfluoroalkyl or perfluoroalkoxy groups on the polymer chain.

The fluoroelastomer may include copolymers of hexafluoropropylene (HFP) and vinylidene fluoride (VDF or VF2), terpolymers of tetrafluoroethylene (TFE), vinylidene fluoride and hexafluoropropylene, perfluoromethylvinylether (PMVE), copolymers of TFE and propylene and copolymers of TFE, PMVE and ethylene. The fluorine content varies for example between 66 to 70 wt % on the total weight of the fluoropolymer seal. In addition, a method of forming the lubricant composition is provided. The method may include combining the base oil, the amine compound and/or the seal compatibility additive. The seal compatibility additive and/or amine compound may be incorporated into the base oil in any convenient way. Thus, the seal compatibility additive and/or amine compound can be added directly to the base oil by dispersing or dissolving it in the base oil at the desired level of concentration. Alternatively, the base oil may be combined directly with the seal compatibility additive and/or amine compound in conjunction with agitation until the seal compatibility additive is provided at the desired level of concentration. Such combining may occur at ambient or lower temperatures, such as 30, 25, 20, 15, 10, or 5, ° C.

Examples

Without being limited, in the below examples, exemplary lubricant compositions were formulated by blending each of the components together until homogeneity was achieved.

Lubricant Concentrate #1

A first lubricant concentrate (Lubricant Concentrate #1) containing detergent, aminic antioxidant, phenolic antioxidant, anti-foam, base oil, pour point depressant, anti-wear agent comprising phosphorous, and viscosity modifier was prepared. A reference lubricant (Reference Lubricant #1) was prepared in accordance with Comparative Example C1. This lubricant composition, which is representative of a commercial crankcase lubricant, was used as a baseline to demonstrate the effects of the seal compatibility additive.

Lubricant Concentrate #1 was combined with various different seal compatibility additives and base oil to demonstrate the effect of the seal compatibility additives on compatibility with fluoropolymer seals. Other components were combined with the lubricant concentrate in combination with the seal compatibility additive to demonstrate synergies between the seal compatibility additive and these other components with respect to compatibility with fluoropolymer seals The seal compatibility additive used in Practical Examples P1, P5, and P9 was 1-iodohexane. The seal compatibility additive used in Practical Examples P2, P6, and P10 was 3-iodo-propanol. The seal compatibility additive used in Practical Examples P3, P7, P11, and P13 was 1-iodododecane. The seal compatibility additive used in Practical Examples P4, P8, and P12 was 1,4-diiodobutane.

The seal compatibility additive used in Comparative Examples C2, C11, and C20 was 1-bromohexane. The seal compatibility additive used in Comparative Examples C3, C12, C21, and C24 was 1-bromododecane. The seal compatibility additive used in Comparative Examples C4, C13, and C22 was 1,4-dibromobutane. The seal compatibility additive used in Comparative Examples C6 and C15 was 1-chlorodecane. The seal compatibility additive used in Comparative Examples C7 and C16 was 1-fluorooctane. The seal compatibility additive used in Comparative Examples C8 and C17 was 4-bromoanisole. The seal compatibility additive used in Comparative Examples C9 and C18 was 1-iodopropane. The seal compatibility additive used in Comparative Examples C10 and C19 was 1-bromopropane.

The dispersant used in Practical Examples P5-P13 and Comparative Examples P5-P24 is a non-borated amine dispersant having a weight average molecular weight of approximately 2250.

The amine compound used in Practical Examples P9-P12 and Comparative Examples C14-C22 was 2,2,6,6-tetramethyl-4-piperidyl dodecanoate. The amine compound used in Practical Example P13 and Comparative Examples C23-C24 was Bis-(2-ethylhexyl)amine.

The respective amount of the Lubricant Concentrate #1 and any additional components for each of the examples are shown in Tables 2-8 below:

TABLE 2

Formulations of Practical Examples 1-4 (P1-P4) and Comparative Examples 1-4 (C1-C4)

| | Example # | | | | | | | |
|---|---|---|---|---|---|---|---|---|
| | P1 | P2 | P3 | P4 | C1 | C2 | C3 | C4 |
| Lubricant Concentrate #1 (g) | 72.000 | 72.000 | 72.000 | 72.000 | 72.000 | 72.000 | 72.000 | 72.000 |
| Additional Base Oil (g) | 27.642 | 27.686 | 27.500 | 27.738 | 28.000 | 27.721 | 27.579 | 27.818 |
| Seal Compatibility Additive (g) | 0.358 | 0.314 | 0.500 | 0.262 | 0 | 0.279 | 0.421 | 0.182 |
| Amine Compound (g) | 0 | 0 | 0 | 0 | 0 | 0 | 0 | 0 |
| Dispersant (g) | 0 | 0 | 0 | 0 | 0 | 0 | 0 | 0 |
| Total Weight (g) | 100 | 100 | 100 | 100 | 100 | 100 | 100 | 100 |

TABLE 3

Formulations of Practical Example 5 (P5) and Comparative Examples 5-11 (C5-C11)

| | Example # | | | | | | | |
|---|---|---|---|---|---|---|---|---|
| | P5 | C5 | C6 | C7 | C8 | C9 | C10 | C11 |
| Lubricant Concentrate #1 (g) | 72.000 | 72.000 | 72.000 | 72.000 | 72.000 | 72.000 | 72.000 | 72.000 |
| Additional Base Oil (g) | 19.642 | 20.000 | 19.702 | 19.777 | 19.684 | 19.713 | 19.792 | 19.721 |
| Seal Compatibility Additive (g) | 0.358 | 0 | 0.298 | 0.223 | 0.316 | 0.287 | 0.208 | 0.279 |
| Amine Compound (g) | 0 | 0 | 0 | 0 | 0 | 0 | 0 | 0 |
| Dispersant (g) | 8.000 | 8.000 | 8.000 | 8.000 | 8.000 | 8.000 | 8.000 | 8.000 |
| Total Weight (g) | 100 | 100 | 100 | 100 | 100 | 100 | 100 | 100 |

TABLE 4

Formulations of Practical Examples 6-8 (P6-P8) and Comparative Examples12-13 (C12-C13)

| | Example # | | | | |
|---|---|---|---|---|---|
| | P6 | P7 | P8 | C12 | C13 |
| Lubricant Concentrate #1 (g) | 72.000 | 72.000 | 72.000 | 72.000 | 72.000 |
| Additional Base Oil (g) | 19.686 | 19.500 | 19.738 | 19.579 | 19.818 |
| Seal Compatibility Additive (g) | 0.314 | 0.500 | 0.262 | 0.421 | 0.182 |
| Amine Compound (g) | 0 | 0 | 0 | 0 | 0 |
| Dispersant (g) | 8.000 | 8.000 | 8.000 | 8.000 | 8.000 |
| Total Weight (g) | 100 | 100 | 100 | 100 | 100 |

TABLE 5

Formulations of Practical Example 9 (P9) and Comparative Examples 14-20 (C14-C20)

| | Example # | | | | | | | |
|---|---|---|---|---|---|---|---|---|
| | P9 | C14 | C15 | C16 | C17 | C18 | C19 | C20 |
| Lubricant Concentrate #1 (g) | 72.000 | 72.000 | 72.000 | 72.000 | 72.000 | 72.000 | 72.000 | 72.000 |
| Additional Base Oil (g) | 18.142 | 18.500 | 18.202 | 18.277 | 18.184 | 18.213 | 18.292 | 18.221 |
| Seal Compatibility Additive (g) | 0.358 | 0 | 0.298 | 0.223 | 0.316 | 0.287 | 0.208 | 0.279 |
| Amine Compound (g) | 1.500 | 1.500 | 1.500 | 1.500 | 1.500 | 1.500 | 1.500 | 1.500 |
| Dispersant (g) | 8.000 | 8.000 | 8.000 | 8.000 | 8.000 | 8.000 | 8.000 | 8.000 |
| Total Weight (g) | 100 | 100 | 100 | 100 | 100 | 100 | 100 | 100 |

TABLE 6

Formulations of Practical Examples 10-12 (P10-P12) and Comparative Examples 21-22 (C21-C22)

| | Example # | | | | |
|---|---|---|---|---|---|
| | P10 | P11 | P12 | C21 | C22 |
| Lubricant Concentrate #1 (g) | 72.000 | 72.000 | 72.000 | 72.000 | 72.000 |
| Additional Base Oil (g) | 18.186 | 18.000 | 18.238 | 18.079 | 18.500 |
| Seal Compatibility Additive (g) | 0.314 | 0.500 | 0.262 | 0.421 | 0.182 |
| Amine Compound (g) | 1.500 | 1.500 | 1.500 | 1.500 | 1.500 |
| Dispersant (g) | 8.000 | 8.000 | 8.000 | 8.000 | 8.000 |
| Total Weight (g) | 100 | 100 | 100 | 100 | 100 |

TABLE 7

Formulations of Practical Example 13 (P13) and Comparative Examples 23-24 (C23-C24)

| | Example # | | |
|---|---|---|---|
| | P13 | C23 | C24 |
| Lubricant Concentrate #1 (g) | 72.000 | 72.000 | 72.000 |
| Additional Base Oil (g) | 18.500 | 19.000 | 18.579 |
| Seal Compatibility Additive (g) | 0.500 | 0 | 0.421 |
| Amine Compound (g) | 1.000 | 1.000 | 1.000 |
| Dispersant (g) | 8.000 | 8.000 | 8.000 |
| Total Weight (g) | 100 | 100 | 100 |

The seal compatibility of exemplary lubricant compositions were tested according to the industry-standard CEC L-39-T96 seal compatibility test. The CEC-L-39-T96 seal compatibility test is performed by submitting the seal in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition. The results of the compatibility tests are shown below in Tables 8-13:

TABLE 8

Seal Compatibility Test Results - Practical Examples 1-4 (P1-P4) and Comparative Examples 1-4 (C1-C4)

| | Example # | | | | | | | |
|---|---|---|---|---|---|---|---|---|
| | P1 | P2 | P3 | P4 | C1 | C2 | C3 | C4 |
| Volume Change (%) | 0.4 | 0.4 | 0.8 | 1 | 0.4 | 0.5 | 0.7 | 0.9 |
| Points Hardness DIDC | 1 | −1 | −1 | −1 | −1 | −2 | −1 | −1 |
| Tensile Strength (%) | 5 | 2 | 2 | 5 | 1 | 6 | 6 | 6 |
| Elongation at Rupture (%) | −15 | −13 | −10 | −13 | −21 | −14 | −12 | −14 |

TABLE 9

Seal Compatibility Test Results - Practical Example 5 (P5) and Comparative Examples 5-11 (C5-C11)

| | Example # | | | | | | | |
|---|---|---|---|---|---|---|---|---|
| | P5 | C5 | C6 | C7 | C8 | C9 | C10 | C11 |
| Volume Change (%) | 0.7 | 0.35 | 0.45 | 0.5 | 0.8 | 0.6 | 0.5 | 0.3 |
| Points Hardness DIDC | 1 | 2 | 2 | 1 | 2 | −5 | 1.5 | −1 |
| Tensile Strength (%) | −6 | −14 | −13 | −13 | −22 | −14 | −19 | −11 |
| Elongation at Rupture (%) | −18 | −39 | −36 | −36 | −37 | −34 | −33 | −24 |

TABLE 10

Seal Compatibility Test Results-Practical Examples 6-8 (P6-P8) and Comparative Examples 12-13 (C12-C13)

| | Example # | | | | |
|---|---|---|---|---|---|
| | P6 | P7 | P8 | C12 | C13 |
| Volume Change (%) | 0.9 | 0.3 | 0.3 | 0.3 | 0.5 |
| Points Hardness DIDC | 0 | 0 | −1 | 1 | 0 |
| Tensile Strength (%) | −15 | −3 | −4 | −10 | −17 |
| Elongation at Rupture (%) | −29 | −14 | −15 | −25 | −33 |

TABLE 11

Seal Compatibility Test Results - Practical Example 9 (P9) and Comparative Examples 14-20 (C14-C20)

| | Example # | | | | | | | |
|---|---|---|---|---|---|---|---|---|
| | P9 | C14 | C15 | C16 | C17 | C18 | C19 | C20 |
| Volume Change (%) | 0.6 | 0.8 | 0.7 | 0.7 | 1.3 | 1.0 | 0.8 | 0.7 |
| Points Hardness DIDC | 2 | 6 | 6 | 4 | 7 | 3 | 6 | 5 |
| Tensile Strength (%) | −23 | −37 | −38 | −35 | −41 | −29 | −38 | −33 |
| Elongation at Rupture (%) | −42 | −68 | −65 | −56 | −68 | −51 | −64 | −55 |

TABLE 12

Seal Compatibility Test Results-Practical Examples 10-12 (P10-P12) and Comparative Examples 21-22 (C21-C22)

| | Example # | | | | |
|---|---|---|---|---|---|
| | P10 | P11 | P12 | C21 | C22 |
| Volume Change (%) | 1.2 | 0.7 | 0.8 | 0.7 | 0.8 |
| Points Hardness DIDC | 3 | 2 | 3 | 4 | 5 |
| Tensile Strength (%) | −28 | −22 | −29 | −33 | −36 |
| Elongation at Rupture (%) | −41 | −42 | −50 | −55 | −60 |

TABLE 13

Seal Compatibility Test Results-Practical Example 13 and Comparative Examples 23 and 24

| | Example # | | |
|---|---|---|---|
| | P13 | C23 | C24 |
| Volume Change (%) | 3.0 | 2.7 | 1.6 |
| Points Hardness DIDC | 7 | 12 | 9 |
| Tensile Strength (%) | −60 | −71 | −66 |
| Elongation at Rupture (%) | −64 | −76 | −70 |

These examples demonstrate that the exemplary seal compatibility additives improve the compatibility of a lubricant composition with fluoropolymer seals. For example, the examples demonstrate that lubricant compositions that include the seal compatibility additives demonstrate improved tensile strength and/or elongation at rupture, even when combined with components that would ordinarily be expected to negatively affect the seal compatibility of the lubricant composition in a significant way. In summary, lubricant compositions that include the seal compatibility additives demonstrate superior results when compared to lubricant compositions that do not include the seal compatibility additives.

These examples also demonstrate that the seal compatibility additives, in combination with an amine compound, improve the compatibility of a lubricant composition with fluoropolymer seals. For example, the examples demonstrate that lubricant compositions that include the seal compatibility additives in combination with an amine compound, demonstrate improved tensile strength and/or elongation at rupture, even when combined with components that would ordinarily be expected to negatively affect the seal compatibility of the lubricant composition in a significant way. In summary, lubricant compositions that include the seal compatibility additives and the amine compound demonstrate superior results when compared to lubricant compositions that do not include the seal compatibility additives and/or the amine compound.

Reference Concentrate #2

A second lubricant concentrate (Lubricant Concentrate #2) containing detergent, aminic antioxidant, phenolic antioxidant, friction modifier, anti-foam, base oil, pour point depressant, anti-wear agent comprising phosphorous, and viscosity modifier was prepared to test the effects of various seal compatibility additives on deposition. A second reference lubricant (Reference Lubricant #2) was prepared in accordance with Comparative Example C25. This lubricant composition, which is representative of a commercial crankcase lubricant, was used as a baseline to demonstrate the anti-deposit effects of the seal compatibility additive.

Reference Concentrate #2 was combined with various different seal compatibility additives and base oil to demonstrate the effect of the seal compatibility additives on deposition. Other components were combined with the reference lubricant in combination with the seal compatibility additive to demonstrate synergies between the seal compatibility additive and these other components with respect to compatibility with deposition.

The seal compatibility additive used in Practical Examples 14 and 15 was 1-iodododecane.

The dispersant used in Practical Examples 14-15 and Comparative Examples 25-26 is a non-borated amine dispersant having a weight average molecular weight of approximately 2250.

The amine compound used in Practical Example 15 and Comparative Example 26 was 2,2,6,6-tetramethyl-4-piperidyl dodecanoate.

The respective amount of the Lubricant Concentrate #2 and any additional components for each of the examples are shown in Table 14 below:

TABLE 14

Formulations of Practical Examples 14-15 (P14-P15) and Comparative Examples 25-26 (C25-C26)

| | Example # | | | |
|---|---|---|---|---|
| | P14 | P15 | C25 | C26 |
| Lubricant Concentrate #2 (g) | 90.000 | 90.000 | 90.000 | 90.000 |
| Additional Base Oil (g) | 9.730 | 8.230 | 10.000 | 8.500 |
| Seal Compatibility Additive (g) | 0.270 | 0.270 | 0 | 0 |
| Amine Compound (g) | 0 | 1.500 | 0 | 1.500 |
| Dispersant (g) | 3.019 | 3.019 | 3.019 | 3.019 |
| Total Weight (g) | 100 | 100 | 100 | 100 |

The anti-deposition effect of the exemplary lubricant compositions were tested according to the TEOST MHT® test (ASTM D 7097). The TEOST MHT® (ASTM D 7097) test is performed by continuously passing 8.5 g of sample oil with catalyst over a pre-weighed steel Depositor Rod for 24 hours at 285° C. The increase in rod weight caused by deposits was used as a measure of oil performance. The results of the anti-deposition tests are shown below in Table 15:

TABLE 15

Deposit Test Results-Practical Examples P14-P15 (P14-P15) and Comparative Examples 25-26 (C25-C26)

| | Example # | | | |
|---|---|---|---|---|
| | P14 | P15 | C25 | C26 |
| Total Deposit (mg) | 32.0 | 28.7 | 43.4 | 48.3 |

These examples demonstrate that the exemplary seal compatibility additives reduce the amount of deposits formed by a lubricant composition. For example, the examples demonstrate that lubricant compositions that include the seal compatibility additives demonstrate improved deposit results. In summary, lubricant compositions that include the seal compatibility additives demonstrate superior results when compared to lubricant compositions that do not include the seal compatibility additives.

These examples also demonstrate that the seal compatibility additives, in combination with an amine compound, reduce the amount of deposits of a lubricant composition. For example, the examples demonstrate that lubricant compositions that include the seal compatibility additives in combination with an amine compound, demonstrate improved deposit results. In summary, lubricant compositions that include the seal compatibility additives and the amine compound demonstrate superior results when compared to lubricant compositions that do not include the seal compatibility additives and/or the amine compound.

Reference Concentrate #3

A third lubricant concentrate (Lubricant Concentrate #3) containing detergent, aminic antioxidant, phenolic antioxidant, friction modifier, anti-foam, base oil, pour point depressant, anti-wear agent comprising phosphorous, and viscosity modifier was prepared to test the effects of various seal compatibility additives on deposition. A third reference lubricant (Reference Lubricant #3) was prepared in accordance to Comparative Example C27. This lubricant composition, which is representative of a commercial crankcase lubricant, was used as a baseline to demonstrate the anti-deposit effects of the seal compatibility additive.

Lubricant Concentrate #3 was combined with various different seal compatibility additives and base oil to demonstrate the effect of the seal compatibility additives on the antioxidant effect. Other components were combined with the reference lubricant in combination with the seal compatibility additive to demonstrate synergies between the seal compatibility additives and these other components with respect to antioxidant effect.

The seal compatibility additive used in Practical Examples P16 and P17 was 1-iodododecane. The seal compatibility additive used in Practical Examples P18-P19 was 1-iodohexane. The seal compatibility additive in Practical Examples P20-P21 was 1,4-diiodobutane. The seal compatibility additive in Practical Examples P22-P23 was iodobenzene. The seal compatibility additive Practical Examples P24-P26 was 1-iodododecane.

The seal compatibility additive in Comparative Examples C29 and C30 was 1-bromododecane. The seal compatibility additive in Comparative Examples C31 and C32 was iodocyclohexane. The seal compatibility additive in Comparative Examples C33 and C34 was bromocyclohexane. The seal compatibility additive in Comparative Examples C35 and C36 was 4-bromoanisole.

The dispersant used in Practical Examples P16-P26 and Comparative Examples C27-C37 is a non-borated amine dispersant having a weight average molecular weight of approximately 2250.

The amine compound used in Practical Examples P17, P19, P21-P23, P25, and P26 and in Comparative Examples C28, C30, and C31-37 was 2,2,6,6-tetramethyl-4-piperidyl dodecanoate.

The respective amount of the Lubricant Concentrate #3 and any additional components for each of the examples are shown in Tables 16-19 below:

TABLE 16

Formulations of Practical Examples 16-19 (P16-P19) and Comparative Examples 27-28 (C27-C28)

| | Example # | | | | | |
|---|---|---|---|---|---|---|
| | P16 | P17 | P18 | P19 | C27 | C28 |
| Lubricant Concentrate #3 (g) | 90.000 | 90.000 | 90.000 | 90.000 | 90.000 | 90.000 |
| Additional Base Oil (g) | 9.730 | 8.230 | 9.817 | 8.317 | 10.000 | 8.500 |
| Seal Compatibility Additive (g) | 0.270 | 0.270 | 0.183 | 0.183 | 0 | 0 |
| Amine Compound (g) | 0 | 1.500 | 0 | 1.500 | 0 | 1.500 |
| Dispersant (g) | 3.354 | 3.354 | 3.354 | 3.354 | 3.354 | 3.354 |
| Total Weight (g) | 100 | 100 | 100 | 100 | 100 | 100 |

TABLE 17

Formulations of Practical Examples 20-21 (P20-P21) and Comparative Examples 29-30 (C29-C30)

| | Example # | | | |
|---|---|---|---|---|
| | P20 | P21 | C29 | C30 |
| Lubricant Concentrate #3 (g) | 90.000 | 90.000 | 90.000 | 90.000 |
| Additional Base Oil (g) | 9.845 | 8.345 | 9.739 | 8.239 |
| Seal Compatibility Additive (g) | 0.155 | 0.155 | 0.261 | 0.261 |
| Amine Compound (g) | 0 | 1.500 | 0 | 1.500 |
| Dispersant (g) | 3.354 | 3.354 | 3.354 | 3.354 |
| Total Weight (g) | 100 | 100 | 100 | 100 |

TABLE 18

Formulations of Practical Examples 22-23 (P22-23) and Comparative Examples 31-36 (C31-36)

| | Example # | | | | | | | |
|---|---|---|---|---|---|---|---|---|
| | P22 | P23 | C31 | C32 | C33 | C34 | C35 | C36 |
| Lubricant Concentrate #3 (g) | 90.000 | 90.000 | 90.000 | 90.000 | 90.000 | 90.000 | 90.000 | 90.000 |
| Additional Base Oil (g) | 8.156 | 8.328 | 8.145 | 8.323 | 8.225 | 8.362 | 8.184 | 8.342 |
| Seal Compatibility Additive (g) | 0.344 | 0.172 | 0.355 | 0.177 | 0.275 | 0.138 | 0.316 | 0.158 |
| Amine Compound (g) | 1.500 | 1.500 | 1.500 | 1.500 | 1.500 | 1.500 | 1.500 | 1.500 |
| Dispersant (g) | 3.354 | 3.354 | 3.354 | 3.354 | 3.354 | 3.354 | 3.354 | 3.354 |
| Total Weight (g) | 100 | 100 | 100 | 100 | 100 | 100 | 100 | 100 |

TABLE 19

Formulations of Practical Examples 24-26 (P24-P26) and Comparative Example 37

| | Example # | | | |
|---|---|---|---|---|
| | P24 | P25 | P26 | C37 |
| Lubricant Concentrate #3 (g) | 90.000 | 90.000 | 90.000 | 90.000 |
| Additional Base Oil (g) | 9.865 | 8.365 | 9.115 | 9.250 |
| Seal Compatibility Additive (g) | 0.135 | 0.135 | 0.135 | 0 |
| Amine Compound (g) | 0 | 1.500 | 0.750 | 0.750 |
| Dispersant (g) | 3.019 | 3.019 | 3.019 | 3.019 |
| Total Weight (g) | 100 | 100 | 100 | 100 |

The antioxidant effect of the exemplary lubricant compositions were tested according to a VIT and by assessing the total acid number (TAN)/TBN cross-over point. The TAN is a measurement of acidity that id determined by the amount of potassium hydroxide in milligrams that is needed to neutralize the acids in one gram of the lubricant composition. The TBN is a measurement of the basicity that is determined by a calculation based on the amount of potassium hydroxide equivalents in milligrams that is needed to neutralize the bases in one gram of lubricant composition. For the VIT, the antioxidant benefit is quantified by an increase in hours measured when the difference in KV 40 between the aged lubricant composition and the unaged lubricant composition is 150% compared to that of the initial KV 40. For the TAN,TBN cross-over point, the lubricant composition is aged, which increases the TAN and decreases the TBN. The point in time at which they cross each other is called the TAN, TBN cross-over point. Lubricant compositions which demonstrate a longer duration until they reach 150% of KV or the TAN,TBN cross-over point would be expected to have greater antioxidant effect. The results of the antioxidant tests are shown below in Tables 20-23:

TABLE 20

Oxidation Test Results- Practical Examples 16-19 (P16-P19) and Comparative Examples 27-28 (C27-28)

| | Example # | | | | | |
|---|---|---|---|---|---|---|
| | P16 | P17 | P18 | P19 | C27 | C28 |
| Hours until 150% KV40 | 395 | 419 | 395 | 199 | 235 | 155 |
| Hours until TBN/TAN crossover | 340 | 353 | 217 | 167 | 156 | 108 |

TABLE 21

Oxidation Test Results-Practical Examples 20-21 (P20-P21) and Comparative Examples 29-30 (C29-C30)

| | Example # | | | |
|---|---|---|---|---|
| | P20 | P21 | C29 | C30 |
| Hours until 150% KV40 | 337 | 192 | 255 | 165 |
| Hours until TBN/TAN crossover | 154 | 304 | 165 | 137 |

TABLE 22

Oxidation Test Results- Practical Examples 22-23 (P22-P23) and Comparative Examples 31-36 (C31-36)

| | Example # | | | | | | | |
|---|---|---|---|---|---|---|---|---|
| | P22 | P23 | C31 | C32 | C33 | C34 | C35 | C36 |
| Hours until 150% KV40 | 90 | 85 | 85 | 80 | 77 | 77 | 80 | 77 |
| Hours until TBN/TAN crossover | 98 | 96 | 95 | 95 | 95 | 94 | 95 | 94 |

TABLE 23

Oxidation Test Results-Practical Examples 24-26 (P24-P26) and Comparative Example 37 (C37)

| | Example # | | | |
|---|---|---|---|---|
| | P24 | P25 | P26 | C37 |
| Hours until 150% KV40 | 210 | 196 | 199 | 166 |
| Hours until TBN/TAN crossover | 242 | 219 | 217 | 80 |

These examples demonstrate that the exemplary seal compatibility additives improve the antioxidant effect of a lubricant composition. For example, the examples demonstrate that lubricant compositions that include the seal compatibility additives demonstrate improved antioxidant results as shown the by increase in duration until they reach 150% of KV or the TAN,TBN cross-over point. In summary, lubricant compositions that include the seal compatibility additives demonstrate superior results It is to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and subranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and subranges sufficiently describe and enable various embodiments of the present invention and such ranges and subranges may be further delineated into relevant halves, thirds, quarters, fifths, and so on. As just one example, a range "ranging from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange ranging from at least 10 to 35, a subrange ranging from at least 10 to 25, a subrange from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "ranging from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

The invention claimed is:

1. An additive package for a lubricant composition that provides improved compatibility with fluoropolymer seals, said additive package comprising:

a fluoropolymer seal compatibility additive having a boiling point of from 150 to 450° C. at 1 atmosphere, wherein the fluoropolymer seal compatibility additive comprises an alkyl halide compound having a general formula:

$$C_nH_{(2n+2-m)}X_m \quad (I)$$

where n ranges from 2 to 15, $1 \leq m \leq (2n+2)$, X is iodine; and wherein the alkyl halide compound is a mono-halide, a di-halide, a tri-halide, or a tetra-halide.

2. The additive package of claim 1 wherein said fluoropolymer seal compatibility additive comprises iodododecane.

3. The additive package of claim 1 further comprising an amine compound.

4. The additive package of claim 3 wherein said amine compound comprises a sterically hindered amine compound.

5. The additive package of claim 3 wherein said amine compound comprises a sterically hindered amine compound having a general formula (VI):

(VI)

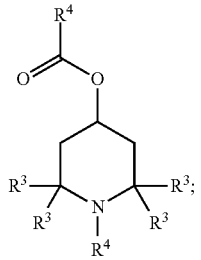

wherein each $R^3$ is independently a hydrogen atom or a hydrocarbyl group having from 1 to 17 carbon atoms;

wherein at least two groups designated by $R^3$ are an alkyl group; and wherein each $R^4$ is independently a hydrogen atom or a hydrocarbyl group having from 1 to 17 carbon atoms.

6. The additive package of claim 3 wherein said amine compound comprises an amine dispersant.

7. The additive package of claim 1 further comprising anti-wear agent comprising phosphorous.

8. A lubricant composition that provides improved compatibility with fluoropolymer seals, said lubricant composition comprising:

a base oil; and a fluoropolymer seal compatibility additive having a boiling point of from 150 to 450° C. at 1 atmosphere, wherein the fluoropolymer seal compatibility additive comprises an alkyl halide compound having a general formula:

$$C_nH_{(2n+2-m)}X_m \quad (I)$$

where n ranges from 2 to 15, $1 \leq m \leq (2n+2)$, X is iodine;

wherein the alkyl halide compound is a mono-halide, a di-halide, a tri-halide, or a tetra-halide; and wherein said fluoropolymer seal compatibility additive is present in an amount ranging from 0.05 to 1 wt. % based on the total weight of said lubricant composition.

9. The lubricant composition of claim 8 wherein said fluoropolymer seal compatibility additive comprises iodododecane.

10. The lubricant composition of claim 8 wherein said fluoropolymer seal compatibility additive is present in an amount ranging from 0.01 to 10 wt. % based on the total weight of said lubricant composition.

11. The lubricant composition of claim 8 further comprising an amine compound.

12. The lubricant composition of claim 11 wherein said amine compound is present in an amount ranging from 0.01 to 10 wt. % based on the total weight of said lubricant composition.

13. The lubricant composition of claim 11 wherein said amine compound comprises a sterically hindered amine compound.

14. The lubricant composition of claim 11 wherein said amine compound comprises a sterically hindered amine compound having a general formula (VI):

(VI)

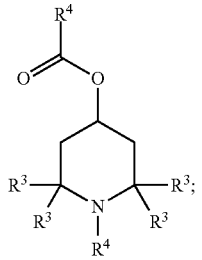

wherein each $R^3$ is independently a hydrogen atom or a hydrocarbyl group having from 1 to 17 carbon atoms;

wherein at least two groups designated by $R^3$ are an alkyl group; and wherein each $R^4$ is independently a hydrogen atom or a hydrocarbyl group having from 1 to 17 carbon atoms.

15. The lubricant composition of claim 8 further comprising an anti-wear agent comprising phosphorous.

16. The lubricant composition of claim 8 having a fluoropolymer seal compatibility such that a fluoropolymer seal submerged in said lubricant composition exhibits a change in elongation of from −60 to 10% or a change in tensile strength of from −50 to 10%, when tested according to CEC L-39-T96.

17. A method of lubricating a system comprising a fluoropolymer seal, said method comprising:

providing a lubricant composition that comprises a base oil and a fluoropolymer seal compatibility additive having a boiling point of from 150 to 450° C. at 1 atmosphere, wherein the fluoropolymer seal compatibility additive comprises an alkyl halide compound having a general formula:

$$C_nH_{(2n+2-m)}X_m \quad (I)$$

where n ranges from 2 to 15, $1 \leq m \leq (2n+2)$, X is iodine;

wherein the alkyl halide compound is a mono-halide, a di-halide, a tri-halide, or a tetra-halide; and wherein said fluoropolymer seal compatibility additive is present in an amount ranging from 0.05 to 1 wt. % based on the total weight of said lubricant composition; and contacting the fluoropolymer seal with the lubricant composition.

* * * * *